US012788196B2

(12) United States Patent
Lee et al.

(10) Patent No.: US 12,788,196 B2
(45) Date of Patent: Nov. 10, 2026

(54) WET CLOTH MODULE FOR CLEANER

(71) Applicant: LG Electronics Inc., Seoul (KR)

(72) Inventors: Donggeun Lee, Seoul (KR); Sungjun Kim, Seoul (KR); Kyoungho Ryou, Seoul (KR)

(73) Assignee: LG Electronics Inc., Seoul (KR)

( * ) Notice: Subject to any disclaimer, the term of this patent is extended or adjusted under 35 U.S.C. 154(b) by 265 days.

(21) Appl. No.: 18/681,418

(22) PCT Filed: Jul. 19, 2022

(86) PCT No.: PCT/KR2022/010515
§ 371 (c)(1),
(2) Date: Feb. 5, 2024

(87) PCT Pub. No.: WO2023/013926
PCT Pub. Date: Feb. 9, 2023

(65) Prior Publication Data

US 2024/0358215 A1 Oct. 31, 2024

(30) Foreign Application Priority Data

Aug. 5, 2021 (KR) ..... 10-2021-0102906

(51) Int. Cl.
*A47L 11/282* (2006.01)
*A47L 11/40* (2006.01)

(52) U.S. Cl.
CPC ..... *A47L 11/282* (2013.01); *A47L 11/4069* (2013.01); *A47L 11/4088* (2013.01)

(58) Field of Classification Search
CPC . A47L 11/282; A47L 11/4069; A47L 11/4088
See application file for complete search history.

(56) References Cited

U.S. PATENT DOCUMENTS

2005/0050671 A1 3/2005 Brennan et al.
2019/0328202 A1* 10/2019 Yang ..... A47L 11/2025
2021/0145237 A1* 5/2021 Yang ..... A47L 11/4069

FOREIGN PATENT DOCUMENTS

CN 102961085 A 3/2013
CN 109068911 A 12/2018
(Continued)

OTHER PUBLICATIONS

JP 6643796 B2—English Machine Translation (Year: 2020).*
(Continued)

*Primary Examiner* — Marc Carlson
(74) *Attorney, Agent, or Firm* — Fish & Richardson P.C.

(57) ABSTRACT

The present invention relates to a wet duster module of a cleaner for sucking or wiping dust or foreign substance in an area to be cleaned by discharging water to a duster. The wet duster module of the cleaner according to the embodiment of the present disclosure can cause forced convection of the air in the inner space through the passage hole that communicates the suction passage and the inner space of the module housing without having a separate cooling module. Therefore, the cooling efficiency of the driving unit disposed in the inner space can be increased. Accordingly, this can not only contribute to the miniaturization of the wet duster module but also adopt the drive motor with higher output, thereby enabling high performance of the wet duster module.

20 Claims, 18 Drawing Sheets

(56) References Cited

FOREIGN PATENT DOCUMENTS

| | | | |
|---|---|---|---|
| EP | 3662804 | A1 | 6/2020 |
| JP | 2016-049128 | A | 4/2016 |
| JP | 6643796 | | 4/2016 |
| JP | 6643796 | B2 * | 2/2020 |
| KR | 10-0400515 | | 10/2001 |
| KR | 10-0667875 | | 1/2007 |
| KR | 10-0813541 | B1 | 3/2008 |
| KR | 10-2021-0035145 | | 3/2021 |
| KR | 10-2234184 | | 4/2021 |

OTHER PUBLICATIONS

Extended European Search Report in European Appln. No. 22853305.5, mailed on Jul. 16, 2025, 8 pages.
Office Action in Chinese Appln. No. 202280051975.X, mailed on May 28, 2026, 12 pages (with English translation).

* cited by examiner

WET CLOTH MODULE FOR CLEANER

CROSS-REFERENCE TO RELATED APPLICATIONS

This application is a National Stage application under 35 U.S.C. § 371 of International Application No. PCT/KR2022/010515, filed on Jul. 19, 2022, which claims the benefit of Korean Application No. 10-2021-0102906, filed on Aug. 5, 2021. The disclosures of the prior applications are incorporated by reference in their entirety.

TECHNICAL FIELD

The present invention relates to a wet duster module of a cleaner, and more particularly, to a wet duster module of the cleaner for sucking or wiping dust or foreign substance in an area to be cleaned by discharging water to a duster.

BACKGROUND ART

A cleaner is a device that performs cleaning by sucking or wiping dust or foreign substance in an area to be cleaned.

Such a cleaner may be divided into a manual cleaner in which a user directly moves the cleaner to perform cleaning, and an automatic cleaner which performs cleaning while driving by itself.

Also, the manual cleaner may be classified into a canister-type cleaner, an upright-type cleaner, a handy-type cleaner, a stick-type cleaner and the like, depending on the shape of the cleaner.

The cleaner is able to clean the surface to be cleaned by using a cleaner head or a module. Generally, the cleaner head or module can be used to suck air and dust. Here, depending on the type of the head or module, a duster is attached and can clean the floor.

Also, water is discharged to the duster and the water-absorbed duster can clean the floor.

Korean Laid-Open Patent Application No. 10-2019-0125917 (Nov. 7, 2019) discloses a cleaner nozzle.

The cleaner nozzle disclosed in the laid-open patent application includes a drive motor that provides rotation power to the duster. The duster is configured to receive water from a water tank.

However, the drive motor in the disclosed patent does not have a separately installed cooling structure and is cooled by natural convection of air, so that there is a limit to the cooling efficiency. Therefore, there is a problem that it is difficult to apply a high-output drive motor which inevitably generates more heat.

For the purpose of improving this, there is a method for installing a separate cooling device. However, this has a problem of increasing the size of the wet duster module due to added parts.

Therefore, there is a need to develop a wet duster module capable of improving the cooling efficiency without actually increasing the overall size of the module.

DISCLOSURE

Technical Problem

The embodiments of the present disclosure are designed to overcome the problems of a conventional wet duster module of a cleaner. The purpose of the present disclosure is to provide a wet duster module capable of improving the cooling efficiency of a drive motor without increasing the overall size of the wet duster module.

Technical Solution

One embodiment is a wet duster module which is used in connection with a cleaner and is placed on a surface to be cleaned. The wet duster module includes: a module housing which has an inner space; a first passage which allows dust-containing air to flow therethrough and extends in the left and right direction from a bottom surface of the module housing; a second passage which is connected to the first passage, allows the air containing the dust sucked from the first passage to flow therethrough, and extends in the forward and backward direction of the module housing; a rotation cleaning unit which is positioned behind the first passage and is disposed apart in the left and right direction on the bottom surface of the module housing such that the second passage is disposed between the rotation cleaning units; a driving unit which is disposed apart in the inner space of the module housing in the left and right direction and provides power that rotates the rotation cleaning unit; and a passage hole which communicates the second passage and the inner space of the module housing.

The module housing may include: a module base where the first passage is formed and the driving unit is seated; a module cover which is coupled to an upper side of the module base; and a passage forming part which is disposed between the module base and the module cover, is coupled to the module base, and then forms the second passage.

Here, the passage hole may be formed to pass through a top surface of the passage forming part.

Meanwhile, the wet duster module of a cleaner may further include a connection pipe which is connected to a rear of the module housing and guides the sucked air to the cleaner. The passage forming part may be connected to the first passage through a front end thereof and is connected to the connection pipe through a rear end thereof.

The wet duster module may further include a guide portion which is disposed in the second passage and is connected to the passage hole in order to guide the air in the inner space of the module housing to the second passage.

Here, the guide portion may include: a first guide wall which is connected to the passage hole and protrudes from the top surface of the passage forming part toward a lower portion of the second passage by a predetermined length; and a second guide wall which is connected to the first guide wall and is extended by a predetermined length toward a rear of the second passage.

Here, the second guide wall may be provided to be side by side with the top surface of the passage forming part.

Also, one side end of the second guide wall, which extends toward the rear of the second passage, may be disposed further rearward than the first passage.

Meanwhile, the wet duster module of a cleaner may include an outside air inlet hole which is disposed in the module cover and introduces outside air into an inner space formed by the module base and the module cover.

Here, the outside air inlet hole may be disposed further rearward than a rearmost end of the driving unit.

Advantageous Effect

The wet duster module of the cleaner according to the embodiment of the present disclosure can cause forced convection of the air in the inner space through the passage hole that communicates the suction passage and the inner space of the module housing without having a separate cooling module. Therefore, the cooling efficiency of the driving unit disposed in the inner space can be increased. Accordingly, this can not only contribute to the miniaturization of the wet duster module but also adopt the drive motor with higher output, thereby enabling high performance of the wet duster module.

MODE FOR INVENTION

Figure 1:
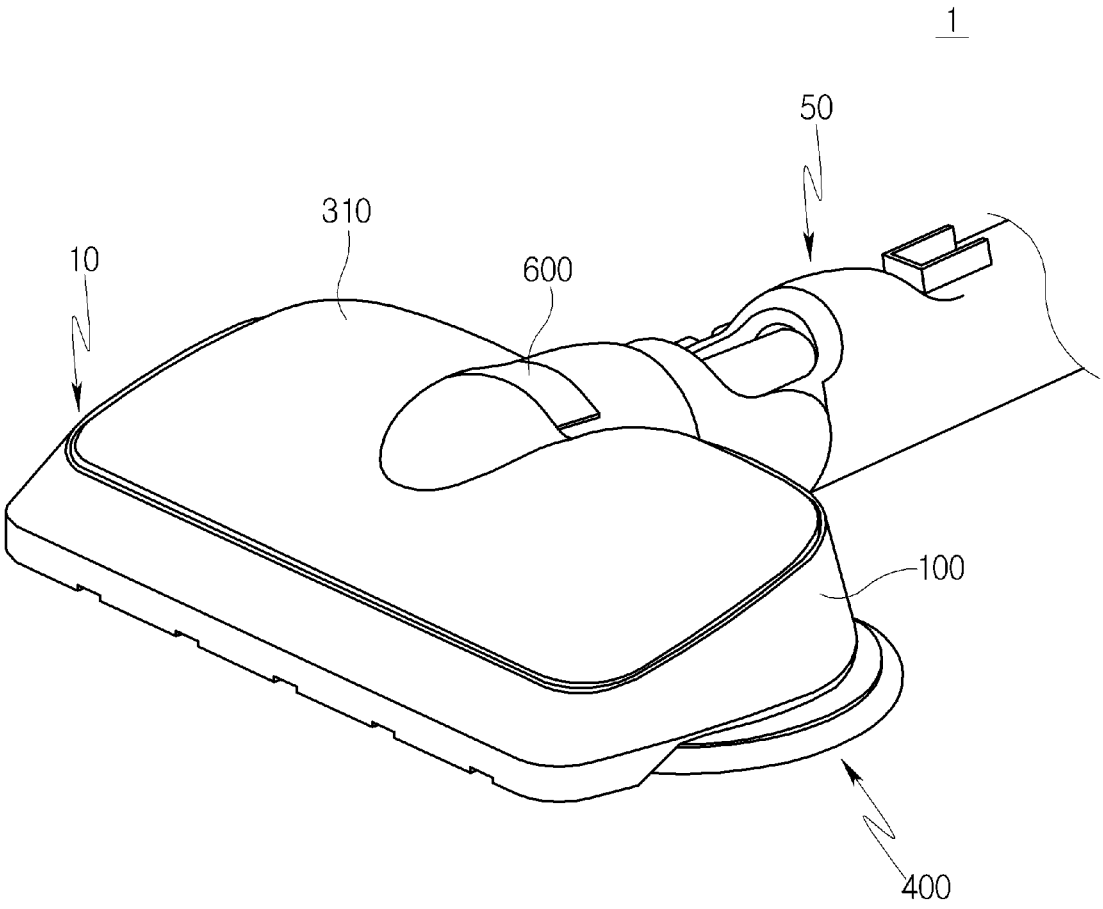
FIG. 1 is a perspective view of a wet duster module of a cleaner according to an embodiment of the present disclosure.
Figure 2:
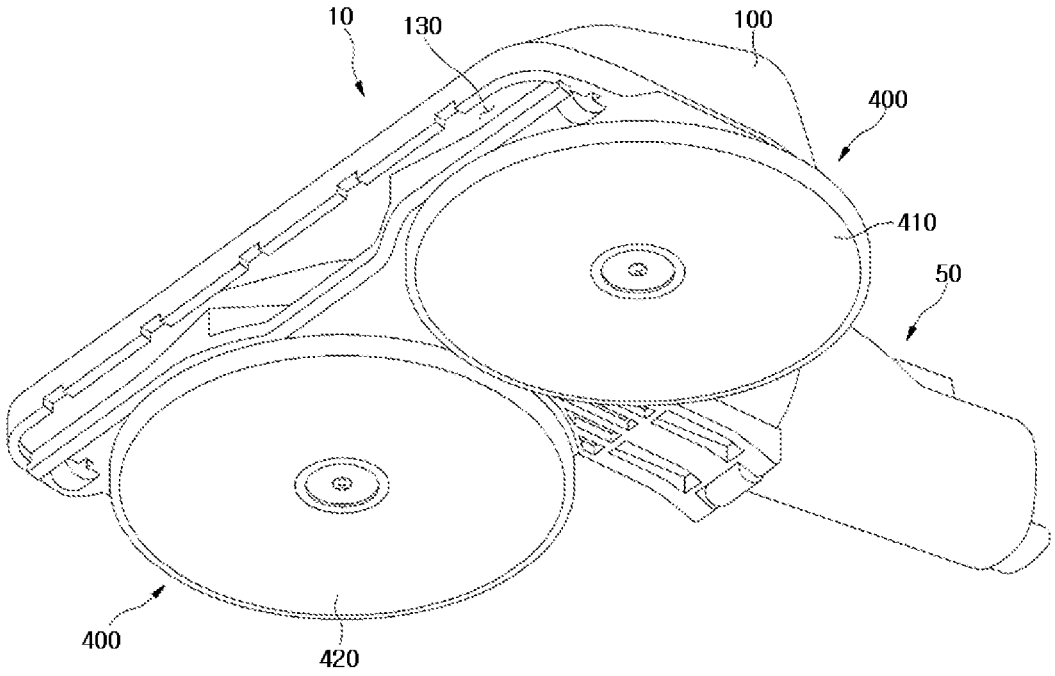
FIG. 2 is a perspective view of the wet duster module of a cleaner according to the embodiment of the present disclosure viewed from another direction.

Hereinafter, preferred embodiments of the present invention will be described in detail with reference to the accompanying drawings.

As the present invention can have various embodiments as well as can be diversely changed, specific embodiments will be illustrated in the drawings and described in detail. While the present invention is not limited to particular embodiments, all modification, equivalents and substitutes included in the spirit and scope of the present invention are understood to be included therein.

In the description of the present invention, while terms such as the first and the second, etc., can be used to describe various components, the components may not be limited by the terms mentioned above. The terms are used only for distinguishing between one component and other components. For example, the first component may be designated as the second component without departing from the scope of rights of the invention. Similarly, the second component may be designated as the first component.

The term of "and/or" includes a combination or one of a plurality of related items mentioned.

In the case where a component is referred to as being "connected" or "accessed" to another component, it should be understood that not only the component is directly connected or accessed to the other component, but also there may exist another component between them. Meanwhile, in the case where a component is referred to as being "directly connected" or "directly accessed" to another component, it should be understood that there is no component therebetween.

Terms used in the present specification are provided for description of only specific embodiments of the present invention, and not intended to be limiting. An expression of a singular form includes the expression of plural form thereof unless otherwise explicitly mentioned in the context.

In the present specification, it should be understood that the term "include" or "comprise" and the like is intended to specify characteristics, numbers, steps, operations, components, parts or any combination thereof which are mentioned in the specification, and intended not to previously exclude the possibility of existence or addition of at least one another characteristics.

Unless otherwise defined, all terms used herein including technical and scientific terms have the same meaning as commonly understood by one of ordinary skill in the art to which the present invention belongs. Terms, for example, commonly used terms defined in the dictionary, are to be construed to have exactly the same meaning as that of related technology in the context. As long as terms are not clearly defined in the present application, the terms should not be ideally or excessively construed as formal meaning.

Also, the embodiment is provided for giving those skilled in the art more complete description. Therefore, the shapes and sizes and the like of components of the drawings may be exaggerated for clarity of the description.

Figure 3:
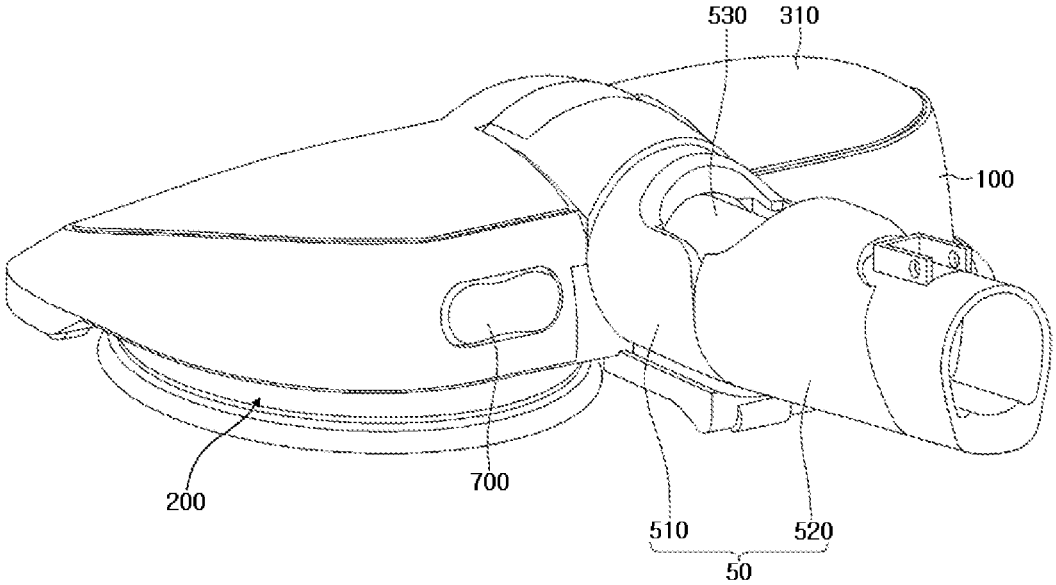
FIG. 3 is a perspective view of the wet duster module of a cleaner of FIG. 1 viewed from the rear.
Figure 4:
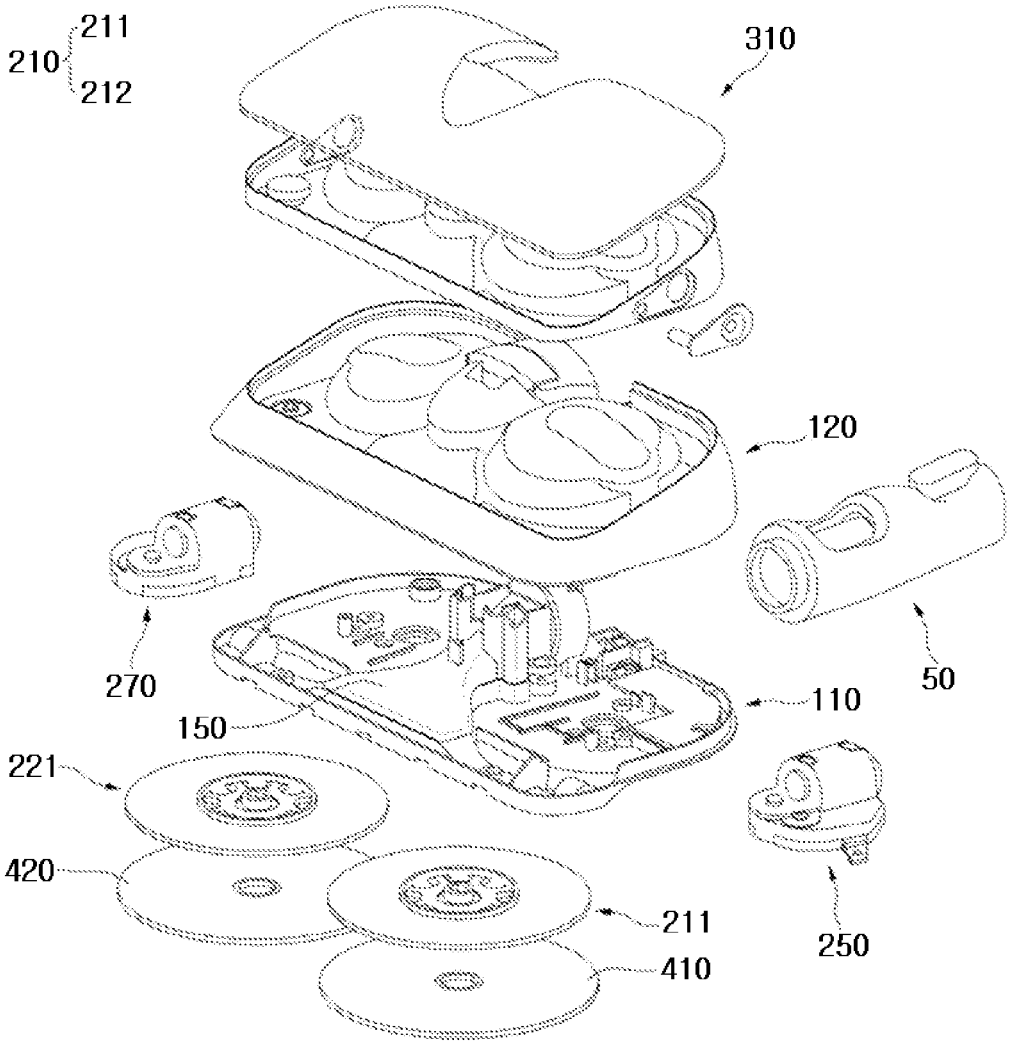
FIG. 4 is an exploded perspective view for describing the wet duster module of a cleaner of FIG. 1.

FIG. 1 is a perspective view of a wet duster module of a cleaner according to an embodiment of the present disclosure. FIG. 3 is a perspective view of the wet duster module of a cleaner of FIG. 1 viewed from the rear. FIG. 4 is an exploded perspective view for describing the wet duster module of a cleaner of FIG. 1.

Referring to FIGS. 1 to 4, a wet duster module 1 of a cleaner according to the embodiment of the present disclosure (hereinafter, referred to as "wet duster module") may include a module body 10 and a connection pipe 50 that is movably connected to the module body 10.

The wet duster module 1 according to the embodiment may be connected to a cleaner for cleaning. As an example, the wet duster module 1 may be used connected to a handy-type cleaner or a canister-type cleaner. The wet duster module 1 may be placed on a surface to be cleaned.

That is, the wet duster module 1 can be detachably connected to the cleaner or an extension pipe of the cleaner. Therefore, as the wet duster module is connected to the cleaner or the extension pipe of the cleaner, a user is able to clean the surface to be cleaned by using the wet duster module 1. Here, the cleaner to which the wet duster module 1 is connected (hereinafter, referred to as "a body of the cleaner") can separate dust in the air by a multi-cyclone method.

The wet duster module 1 may have its own battery and supply power to an internal power consumption unit or may operate by receiving power from a battery installed in the body of the cleaner.

Since the body of the cleaner to which the wet duster module 1 is connected includes a suction motor (not shown in the drawing), a suction force generated by the suction motor acts on the wet duster module 1, so that the wet duster module 1 can suck foreign substances and air of the surface to be cleaned.

Therefore, in the embodiment, the wet duster module 1 may serve to suck the foreign substances and air of the surface to be cleaned and guide them to the body of the cleaner.

The connection pipe 50 is connected to a rear central portion of the module body 10 and can guide the sucked air to the cleaner, but is not limited thereto.

A direction in the embodiment is defined as follows for ease of understanding. a portion to which the connection pipe 50 is connected in the wet duster module 1 may be referred to as a rear of the wet duster module 1, and the opposite side portion of the connection pipe 50 may be referred to as a front of the wet duster module 1.

The wet duster module 1 may further include a rotation cleaning unit 200 that is rotatably provided below the module body 10.

For example, the rotation cleaning unit 200 may be provided in the form of a pair and arranged in the left and right direction. Here, the pair of rotation cleaning units 200 may be rotated independently. As an example, the rotation cleaning unit 200 may include a first rotation cleaning unit 210 and a second rotation cleaning unit 220.

The rotation cleaning unit 200 may be combined with a duster 400. For example, the duster 400 may be formed in a disk shape. The duster 400 may include a first duster 410 and a second duster 420.

The module body 10 may include a module housing 100 that forms an external appearance thereof. The module housing 100 may include suction passages 130 and 140 for sucking air. The module housing 100 may have a space therein.

The suction passages 130 and 140 may include a first passage 130 extending in the left and right direction from the module housing 100, and a second passage 140 communicating with the first passage 130 and extending in the forward and backward direction.

For example, the first passage 130 may be formed at a front portion of a bottom surface of the module housing 100.

The second passage 140 may be connected to the first passage 130 and may extend rearward from the first passage 130. For example, the second passage 140 may extend rearward from the central portion of the first passage 130 toward the connection pipe 50. Air containing dust may be sucked into the first passage 130 and flow through the second passage 140.

In a state where the rotation cleaning units 210 and 220 are connected to the lower side of the module body 10, portions of the dusters 410 and 420 protrude to the outside of the wet duster module 1, so that it is possible to clean not only the surface to be cleaned positioned below the wet duster module 1 but also the surface to be cleaned positioned at the outside of the wet duster module 1.

For example, the dusters 410 and 420 may protrude not only to both sides of the wet duster module 1 but also to the rear of the wet duster module 1.

As an example, the rotation cleaning units 210 and 220 may be positioned behind the first passage 130 below the module body 10. Also, as an example, the first rotation cleaning unit 210 and the second rotation cleaning unit 220 may be arranged on the right and left sides, respectively, with the second passage 140 placed therebetween.

Therefore, when cleaning is performed while moving the wet duster module 1 forward, foreign substances and air on the surface to be cleaned may be sucked by the first passage 130 and then the surface to be cleaned may be wiped by the dusters 410 and 420.

In the embodiment, a first rotation center C1 of the first rotation cleaning unit 210 (for example, a rotation center of a rotating plate 211) and a second rotation center C2 of the second rotation cleaning unit 220 (for example, a rotation center of a rotating plate 221) are disposed apart in the left and right direction.

Figure 10:
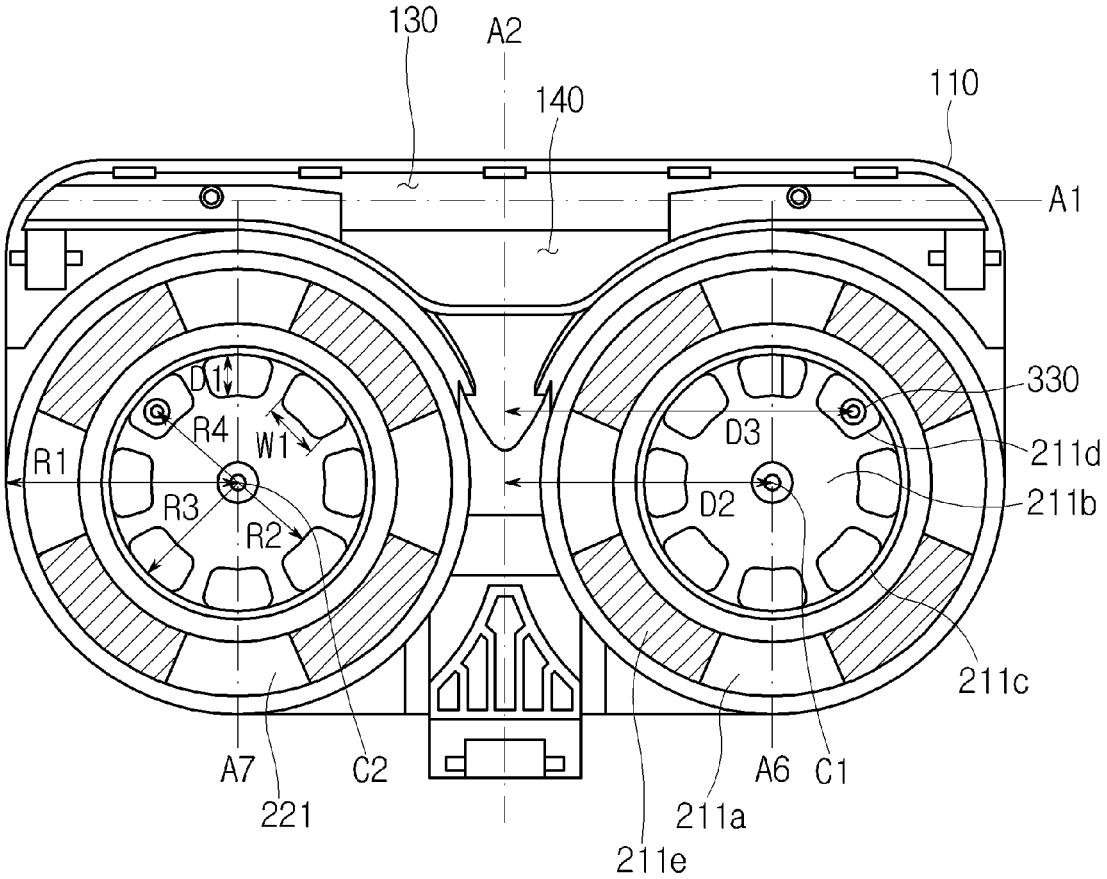
FIG. 10 is a view showing the arrangement of the rotating plate and the water supply nozzle in the wet duster module of a cleaner according to the embodiment of the present disclosure viewed from another direction.

A center line A2 of the second passage 140 may be located in an area between the first rotation center C1 and the second rotation center C2 (see FIG. 10).

The rotation centers C1 and C2 of the rotation cleaning units 210 and 220 may be located farther from a front portion of the module body 10 than a central axis that bisects a front-rear length of the module body 10. This intends to prevent the rotation cleaning units 210 and 220 from blocking the first passage 130.

Also, a distance between the rotation centers C1 and C2 of the rotation cleaning units 210 and 220 may be greater than diameters of the dusters 410 and 420. This intends to reduce mutual friction caused by interference during the rotation of the dusters 410 and 420 and to prevent a cleanable area from being reduced as much as by the interference portion.

The module housing 100 may include a module base 110 and a module cover 120 coupled to the upper side of the module base 110.

The first passage 130 may be formed in the module base 110. Also, the module housing 100 may further include a passage forming part 150 that forms, together with the module base 110, the second passage 140.

The passage forming part 150 may be coupled to an upper central portion of the module base 110, and an end of the passage forming part 150 may be connected to the connection pipe 50. More specifically, a front end of the passage forming part 150 may be connected to the upper side of the first passage 130 and a rear end of the passage forming part 150 may be connected to the connection pipe 50.

Accordingly, since the second passage 140 can be extended in a substantially straight line in the forward and backward direction by the arrangement of the passage forming part 150, the length of the second passage 140 can be minimized and flow loss in the wet duster module 1 can be minimized.

A front portion of the passage forming part 150 may cover the upper side of the first passage 130. The passage forming part 150 may be disposed to be inclined upward from the front portion to a rear portion thereof.

Accordingly, the height of the front portion of the passage forming part 150 may be less than that of the rear portion.

According to the embodiment, since the front portion of the passage forming part 150 has a less height, there is an advantage that the height of the front portion can be reduced among the overall height of the wet duster module 1. The lower the height of the wet duster module 1, the higher the possibility that wet duster module 1 can be pushed into and clean a narrow space under furniture or chairs.

The connection pipe 50 includes a first connection pipe 510 connected to an end of the passage forming part 150, a second connection pipe 520 rotatably connected to the first connection pipe 510, and a guide pipe 530 that communicates the first connection pipe 510 and the second connection pipe 520.

Figure 7:
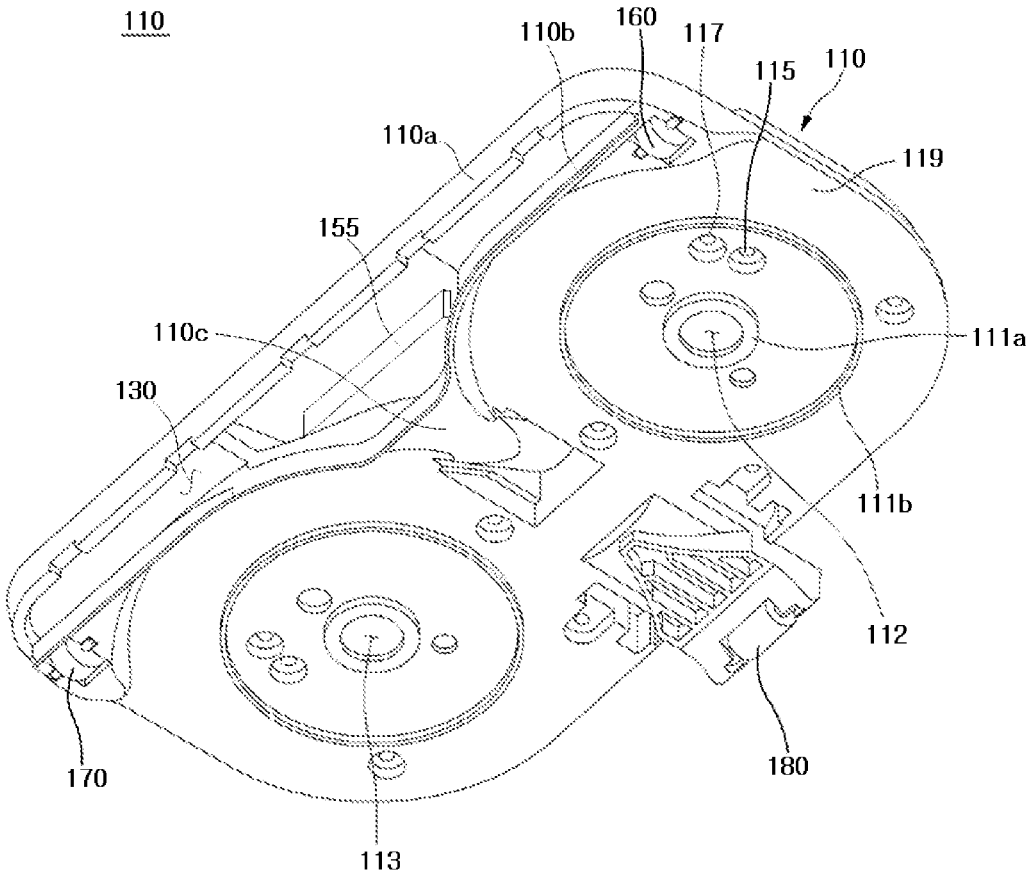
FIG. 7 is a perspective view of the module base in the wet duster module of a cleaner according to the embodiment of the present disclosure viewed from another direction.

A plurality of rollers may be provided on the lower side of the module base 110 for smooth movement of the wet duster module 1 (see FIG. 7).

As an example, a first roller 160 and a second roller 170 may be positioned behind the first passage 130 in the module base 110. The first roller 160 and the second roller 170 may be arranged apart in the left and right direction.

According to the embodiment, the first roller 160 and the second roller 170 are arranged behind the first passage 130, so that the first passage 130 is positioned as close as possible to a front portion of the module base 110. Therefore, an area that can be cleaned by using the wet duster module 1 can be increased.

As a distance from the front portion of the module base 110 to the first passage 130 is longer, an area on which the suction force does not act toward the front of the first passage 130 during the cleaning increases. Accordingly, an area where the cleaning is not performed increases.

On the other hand, according to the embodiment, the distance from the front portion of the module base 110 to the first passage 130 can be minimized, thereby increasing the area where the cleaning is possible.

Also, the first roller 160 and the second roller 170 are arranged behind the first passage 130, so that the left and right length of the first passage 130 can be maximized.

That is, a distance between both ends of the first passage 130 and both side ends of the module base 110 can be minimized.

In the embodiment, the first roller 160 may be positioned in a space between the first passage 130 and the first duster 410. Also, the second roller 170 may be positioned in a space between the first passage 130 and the second duster 420.

The first roller 160 and the second roller 170 may each be rotatably connected to a shaft. The shaft may be fixed to the lower side of the module base 110 while being arranged to extend in the left and right direction.

A distance between the shaft and the front portion of the module base 110 is greater than a minimum distance between the dusters 410 and 420 (or the rotating plate to be described later) and the front portion of the module base 110.

As an example, at least a portion of the rotation cleaning units 210 and 220 (duster and/or rotating plate) may be located between the shaft of the first roller 160 and the shaft of the second roller 170.

According to this arrangement, the rotation cleaning units 210 and 220 can be positioned as close as possible to the first passage 130, so that the area that is cleaned by the rotation cleaning units 210 and 220 among the surfaces to be cleaned on which the wet duster module 1 is located can be increased, and thus, a floor cleaning performance can be improved.

The rollers 160 and 170 are not limited, but can support the wet duster module 1 at three points. That is, the roller may further include a third roller 180 provided on the module base 110.

Also, the third roller 180 may be positioned behind the dusters 410 and 420 in order to prevent interference with the dusters 410 and 420.

When the dusters 410, 420 are placed on the surface to be cleaned, the dusters 410 and 420 are pressed and come into close contact with the surface to be cleaned, thereby increasing friction force between the dusters 410 and 420 and the surface to be cleaned. In the embodiment, since the plurality of rollers is coupled to the lower side of the module base 110, the mobility of the wet duster module 1 can be improved by the plurality of rollers.

Meanwhile, the module body 10 may further include a water tank 310 in order to supply water to the dusters 410 and 420.

The water tank 310 may be detachably connected to the module housing 100. When the water tank 310 is mounted on the module housing 100, water of the water tank 310 may be supplied to the dusters 410 and 420.

The water tank 310 may form an external appearance of the wet duster module 1 when mounted on the module housing 100.

The entire upper wall of the water tank 310 may substantially form an upper side external appearance of the wet duster module 1. Accordingly, a user can check that the water tank 310 is mounted on or is separated from the module housing 100.

The module body 10 may further include an operation unit 600 that operates to separate the water tank 310 in the state where the water tank 310 is mounted on the module housing 100.

In the embodiment, for example, the operation unit 600 may be located above the second passage 140. For example, the operation unit 600 may be arranged to overlap the center line A2 of the second passage 140 in the up and down direction.

Therefore, since the operation unit 600 is located in the central portion of the wet duster module 1, there is an advantage that a user can easily recognize the operation unit 600 and operate the operation unit 600.

Meanwhile, the module body 10 may further include a control unit 700 for controlling the amount of water discharged from the water tank 310. As an example, the control unit 700 may be located at the rear of the module housing 100.

The control unit 700 can be operated by a user, and the water may or may not be discharged from the water tank 310 by the control unit 700.

Alternatively, the amount of water discharged from the water tank 310 can be controlled by the control unit 700. For example, by operating the control unit 700, a first amount of water may be discharged from the water tank 310 per unit time, or a second amount of water, which is greater than the first amount, may be discharged per unit time.

The control unit 700 may be provided to pivot on the module housing 10 in the left and right direction, or may be provided to pivot in the up and down direction according to the embodiment.

For example, when the control unit 700 is, as shown in FIG. 3, located in a neutral position, the amount of the discharged water is 0, and when the left side of the control unit 700 is pushed and the control unit 700 is pivoted to the left, the water tank 310 may discharge the first amount of water per unit time.

In addition, when the right side of the control unit 700 is pushed and the control unit 700 is pivoted to the right, the water tank 310 may discharge the second amount of water per unit time.

Figure 5:
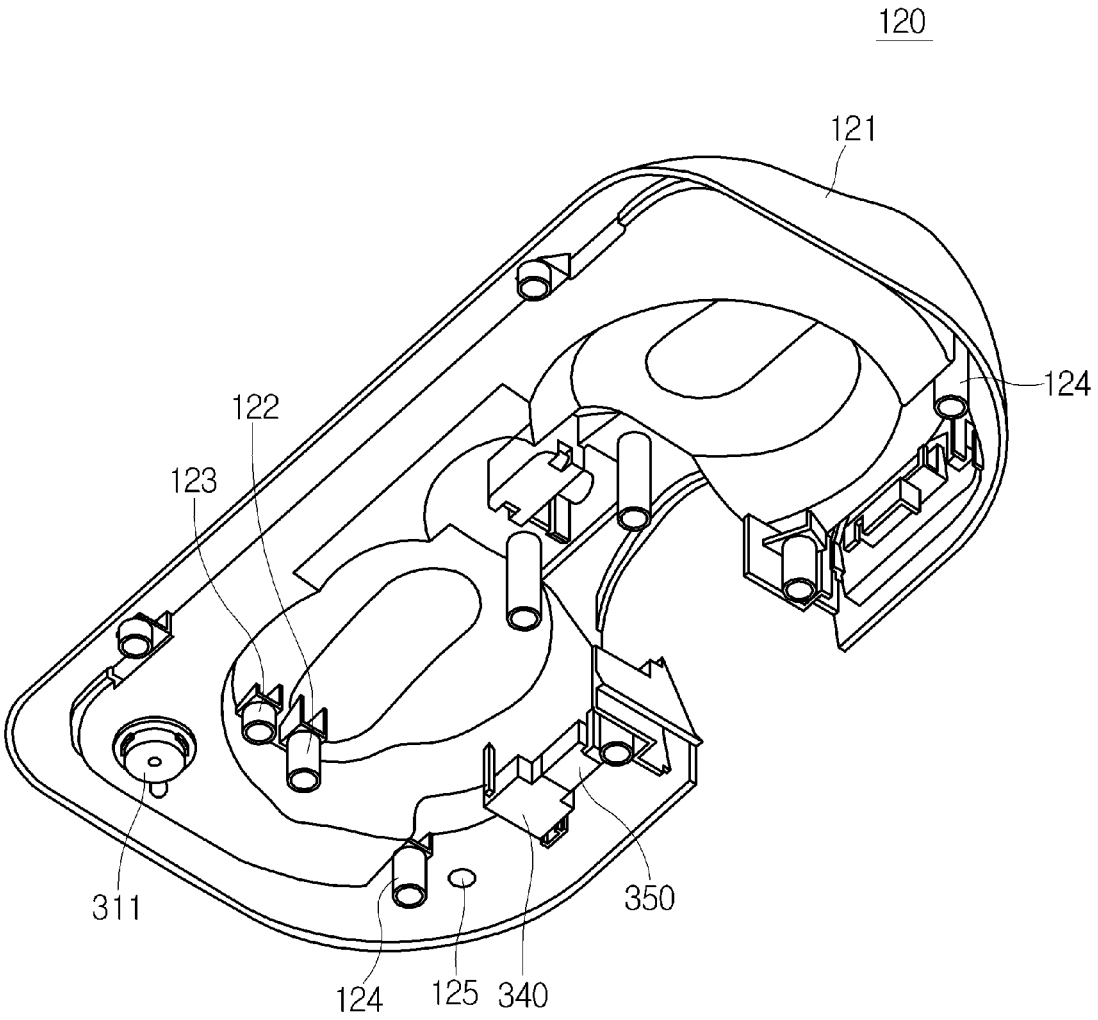
FIG. 5 is a perspective view for describing a module cover in the wet duster module of a cleaner according to the embodiment of the present disclosure.
Figure 6:
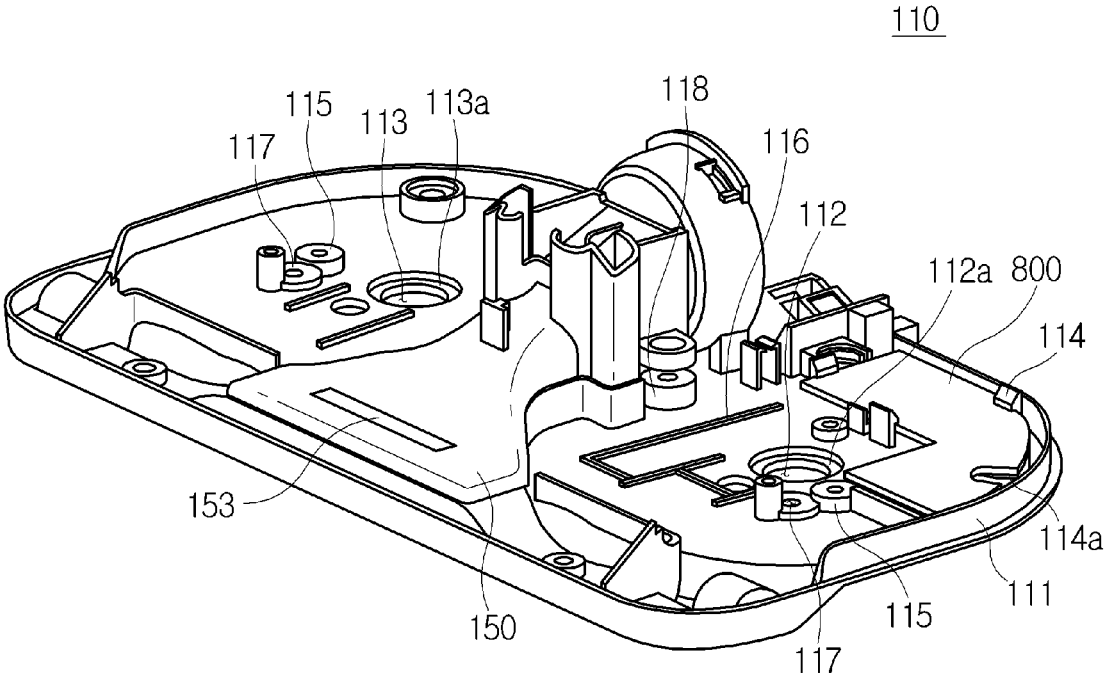
FIG. 6 is a perspective view for describing a module base in the wet duster module of a cleaner according to the embodiment of the present disclosure.

Meanwhile, FIG. 5 is a perspective view for describing the module cover in the wet duster module of the cleaner according to the embodiment of the present disclosure. FIG. 6 is a perspective view for describing the module base in the wet duster module of the cleaner according to the embodiment of the present disclosure. FIG. 7 is a perspective view of the module base in the wet duster module of the cleaner according to the embodiment of the present disclosure viewed from another direction.

Referring to FIGS. 4 to 7, the module body 10 may further include a plurality of driving units 250 and 270 for individually driving the rotation cleaning units 210 and 220.

Specifically, the driving units 250 and 270 may include the first driving unit 250 for driving the first rotation cleaning unit 210 and the second driving unit 270 for driving the second rotation cleaning unit 220.

Since the driving units 250 and 270 operate individually, there is an advantage that even if a failure occurs in some of the driving units 250 and 270 fail, other rotation cleaning units can be rotated by other driving units.

The first driving unit 250 and the second driving unit 270 may be disposed apart in the module body 10 in the left and right direction.

Also, the driving units 250 and 270 may be positioned behind the first passage 130.

For example, the second passage 140 may be positioned between the first driving unit 250 and the second driving unit 270. Here, the first driving unit 250 and the second driving unit 270 may be arranged symmetrically with respect to the center line A2 of the second passage 140.

Therefore, even though the driving units 250 and 270 are provided, the second passage 140 is not affected, and thus, the length of the second passage 140 can be minimized.

According to the embodiment, since the first driving unit 250 and the second driving unit 270 are disposed on both sides of the second passage 140, respectively, the weight of the wet duster module 1 is evenly distributed from side to side. Therefore, it is possible to prevent the center of gravity of the wet duster module 1 from being biased to either side of the mop module 1.

The driving units 250 and 270 may be disposed within the module body 10. For example, the driving units 250 and 270 may be seated on the module base 110 and covered by the module cover 120. That is, the driving units 250 and 270 may be disposed in an inner space of the module housing 100 formed by the module base 110 and the module cover 120. In other words, the driving units 250 and 270 may be positioned between the module base 110 and the module cover 120.

The rotation cleaning units 210 and 220 may further include the rotating plates 211 and 221 that are rotated by receiving power from the driving units 250 and 270.

As an example, the rotating plates 211 and 221 may include the first rotating plate 211 which is connected to the first driving unit 250 and to which the first duster 410 is attached, and the second rotating plate 221 which is connected to the second driving unit 270 and to which the second duster 420 is attached.

The rotating plates 211 and 221 may be formed in a disk shape, and the dusters 410 and 420 may be attached to the bottom surfaces of the rotating plates 211 and 221.

Specifically, the rotating plates 211 and 221 may include an outer body 211*a* in the form of a circular ring, an inner body 211*b* which is located in a central region of the outer body 211*a* and is spaced apart from an inner peripheral surface of the outer body 211*a*, and a plurality of connection ribs 211*c* which connects an outer peripheral surface of the inner body 211*b* and the inner peripheral surface of the outer body 211*a* (see FIG. 10).

Also, the rotating plates 211 and 221 may include a water passage hole 211*d* which is formed in the inner body 211*b* and is formed in plural numbers along the circumferential direction and supplies water discharged through the water tank 310 to the dusters 410 and 420.

Meanwhile, the rotating plates 211 and 221 may include an attachment means 211*e* which is formed in plural numbers along a circumferential direction of the outer body 211*a* and attaches the dusters 410 and 420. For example, the attachment means 211*e* may be Velcro.

The rotating plates 211 and 221 may be connected to the driving units 250 and 270 from the bottom of the module base 110. That is, the rotating plates 211 and 221 may be connected to the driving units 250 and 270 from the module housing 100.

The module cover 120 covers the top of the module base 110 and includes a cover body 121 that forms an external appearance of the wet duster module 1 according to the embodiment of the present disclosure (see FIG. 5).

Meanwhile, a tank connection portion 311 which can operate a valve (not shown) within the water tank 310 and allow water to flow may be coupled to the module cover 120.

The tank connection portion 311 may be coupled to the bottom of the module cover 120, and a portion of the tank connection portion 311 may protrude upward through the module cover 120.

When the water tank 310 is seated on the module cover 120, the tank connection portion 311 protruding upward be pushed into the water tank 310 through an outlet of the water tank 310.

The module cover 120 may be equipped with a sealer which prevent the water discharged from the water tank 310 from leaking around the tank connection portion 311. For example, the sealer may be made of a rubber material and may be coupled to the module cover 120 at the top of the module cover 120.

A water pump 340 may be installed on the module cover 120 in order to control the discharge of the water from the water tank 310. The water pump 340 may be connected to a pump motor 350.

The water pump 340 expands or contracts while an internal valve body thereof operates, and thus, communicates an inlet and an outlet. Since the water pump 340 can be implemented by a known structure, a detailed description thereof will be omitted.

The valve body within the water pump 340 may be operated by the pump motor 350. Therefore, according to the embodiment, while the pump motor 350 is operating, the water of the water tank 310 can be continuously and stably supplied to the rotation cleaning units 210 and 220.

The operation of the pump motor 350 can be controlled by the operation of the above-described control unit 700. For example, on/off of the pump motor 350 may be selected by the control unit 700.

Alternatively, the output (or rotation speed) of the pump motor 350 may be controlled by the control unit 700.

The module cover 120 may further include one or more fastening bosses 124 which allow the module cover 120 to be coupled to the module base 110.

Also, a water supply nozzle 330 for spraying water onto the rotation cleaning units 210 and 220 may be installed on the module cover 120. As an example, the water supply nozzle 330 is provided in the form of a pair, and the pair of water supply nozzles 330 may be installed on the module cover 120 in a state of being spaced apart to the right and left. (See FIG. 10)

The module cover 120 may be provided with nozzle installation bosses 122 and 123 for installing the water supply nozzle 330. As an example, the nozzle installation bosses 122 and 123 may be provided on both sides of the water supply nozzle 330 and may include the first nozzle installation boss 122 and the second nozzle installation boss 123.

Specifically, the first nozzle installation boss 122 may be formed to protrude from an inner surface of the cover body 121 toward the module base 110. As an example, the first nozzle installation boss 122 may be formed in a shape of a hollow cylinder and may be fixedly coupled to the water supply nozzle 330 by means of a screw.

Also, the second nozzle installation boss 123 may be formed to protrude at a predetermined interval from the first nozzle installation boss 122. As an example, the second nozzle installation boss 123 may be formed at a position symmetrical to the first nozzle installation boss 122 with respect to the water supply nozzle 330.

Meanwhile, a plurality of support ribs (not shown) may be formed to protrude and extend outward from an outer peripheral surface of the second nozzle installation boss 123. As an example, the second nozzle installation boss 123 may be formed in a shape of a hollow cylinder. Also, two support ribs may be formed to protrude outward from an outer peripheral surface of the second nozzle installation boss 123 in the radial direction of the second nozzle installation boss 123 at a predetermined interval along the axial direction.

Accordingly, the water supply nozzle 330 can be coupled and fixed to the first nozzle installation boss 122 and the second nozzle installation boss 123. As a result, when an impact is applied from the outside or pressure due to water discharge is applied, the water supply nozzle 330 can be prevented from being separated from the module housing 100 or from shaking.

The module base 110 may include a base body 111 on which the rotation cleaning unit 200 is mounted and which forms an external appearance of the wet duster module 1 according to the embodiment of the present disclosure.

Also, the module base 110 may include a pair of shaft through holes 112 and 113 through which a transmission shaft 255 connected to the rotating plates 211 and 221 in the driving units 250 and 270 passes.

The module base 110 may be formed with seating recesses 112*a* and 113*a* on which a sleeve 256 provided in the driving units 250 and 270 is seated, and the shaft through holes 112 and 113 may be formed in the seating recesses 112*a* and 113*a*.

For example, the seating recesses 112*a* and 113*a* may be formed in a circular shape and may be recessed downward from the module base 110. Also, the shaft through holes 112 and 113 may be formed in the bottom of the seating recesses 112*a* and 113*a*.

The sleeve 256 that protrudes outward may be provided around the transmission shaft 255 of the driving units 250 and 270. Here, the sleeve 256 may be seated in the seating recesses 112*a* and 113*a*, and therefore, horizontal movement of the driving units 250 and 270 may be limited during the movement of the wet duster module 1 or during the operation of the driving units 250 and 270.

A protruding sleeve 111*a* protruding downward is provided at a position corresponding to the seating recesses 112*a* and 113*a* on a bottom surface of the module base 110. The protruding sleeve 111*a* is formed substantially while the bottom surface of the module base 110 protrudes downward as the seating recesses 112*a* and 113*a* are formed downward.

In a state where the passage forming part 150 is coupled to the module base 110, the shaft through holes 112 and 113 may be disposed on both sides of the passage forming part 150.

The module base 110 may be provided with a board installation portion 114 on which a control board 800 (or a first board) for controlling the driving units 250 and 270 is installed. For example, the board installation portion 114 may be formed in a hook shape extending upward from the module base 110.

A hook of the board installation portion 114 may be caught on the top surface of the control board 800, thereby limiting the control board 800 from moving upward.

The control board 800 may be installed horizontally. Also, the control board 800 may be installed to be spaced apart from the bottom of the module base 110. This intends to prevent water from contacting the control board 800 even if the water falls to the bottom of the module base 110. To this end, the module base 110 may be provided with a support protrusion 114*a* that supports the control board 800 to be spaced apart from the bottom.

Although not limited, the board installation portion 114 may be positioned on one side of the passage forming part 150 in the module base 110. For example, the control board 800 may be disposed adjacent to the control unit 700. The control board 800 may be disposed in the rear portion of the module base 110.

Accordingly, a switch installed on the control board 800 can detect the operation of the control unit 700.

The module base 110 may further include a driving unit support rib 116 that supports the lower sides of the driving units 250 and 270.

The driving unit support rib 116 may protrude from the module base 110 and may be bent one or more times, thereby spacing the driving units 250 and 270 from the bottom of the module base 110.

Alternatively, a plurality of the spaced driving unit support ribs 116 may protrude from the module base 110 to space the driving units 250 and 270 from the bottom of the module base 110.

Even though water falls to the bottom of the module base 110, the driving units 250 and 270 are spaced from the bottom of the module base 110 by the driving unit support rib 116, so that it is possible to minimize the flow of the water toward the driving units 250 and 270.

Also, the sleeve 256 provided in the driving units 250 and 270 is seated in the seating recess 112*a*. Therefore, even if water falls to the bottom of the module base 110, the water can be prevented from being introduced into the driving units 250 and 270 by the sleeve 256.

Also, the module base 110 may further include a nozzle hole 117 through which the water supply nozzle 330 passes.

A portion of the water supply nozzle 330 coupled to the module cover 120 can pass through the nozzle hole 117 when the module cover 120 is coupled to the module base 110.

Also, the module base 110 may further include a passage fastening boss 118 for being fastened to the passage forming part 150. Here, a fastening member which has passed through the passage forming part 150 may pass through a portion of the driving units 250 and 270 and then be fastened to the passage fastening boss 118.

With the rotation cleaning units 210 and 220 coupled to the lower side of the module base 110, the lower surface of the module base 110 may be provided with a plate receiving portion 119 recessed upward, such that the first passage 130 is as close as possible to the surface to be cleaned on which the wet duster module 1 is placed.

Here, in the state where the rotation cleaning units 210 and 220 are coupled by the plate receiving portion 119, an increase in the height of the wet duster module 1 can be minimized.

Also, with the rotating plates 211 and 221 positioned in the plate receiving portion 119, the rotating plates 211 and 221 may be coupled to the driving units 250 and 270.

The module base 110 may be provided with a bottom rib 1/1*b* disposed to surround the shaft through holes 112 and 113. For example, the bottom rib 111*b* may protrude downward from a lower surface of the plate receiving portion 119 and may be formed in the form of a circular ring.

The shaft through holes 112 and 113 and the nozzle hole 117 may be located within a region formed by the bottom rib 111*b*.

Figure 8:
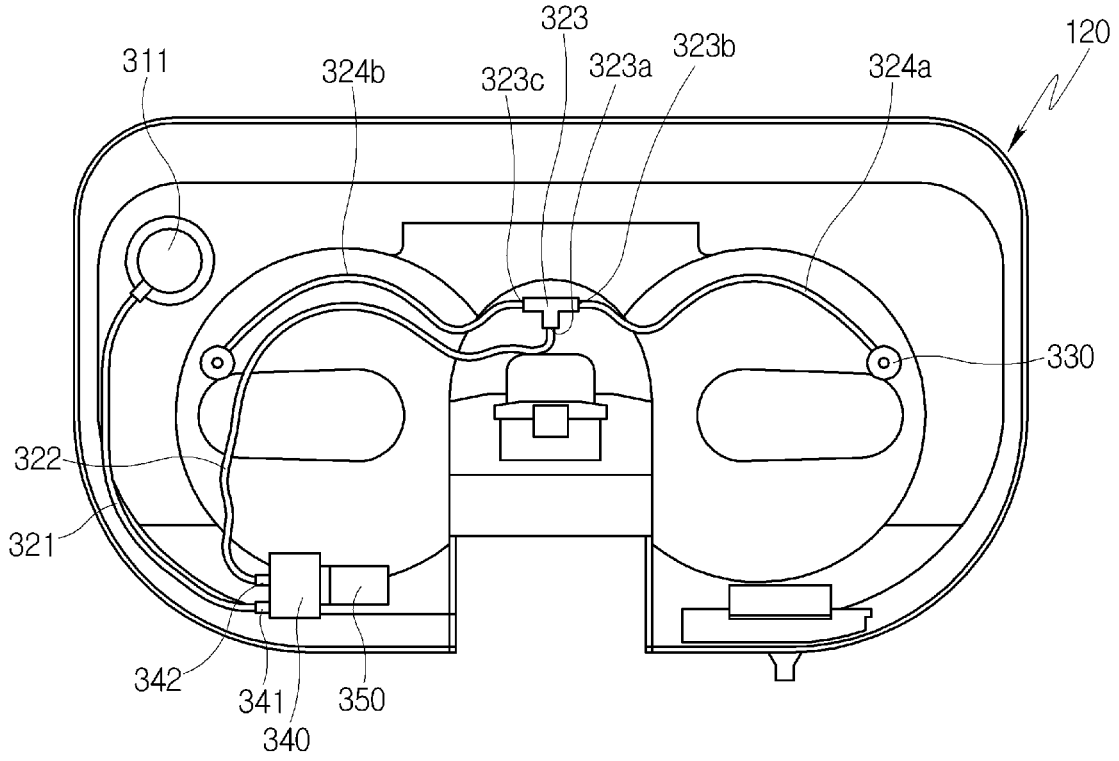
FIG. 8 is a view showing the arrangement of a rotating plate and a water supply nozzle in the wet duster module of a cleaner according to the embodiment of the present disclosure viewed from another direction.
Figure 9:
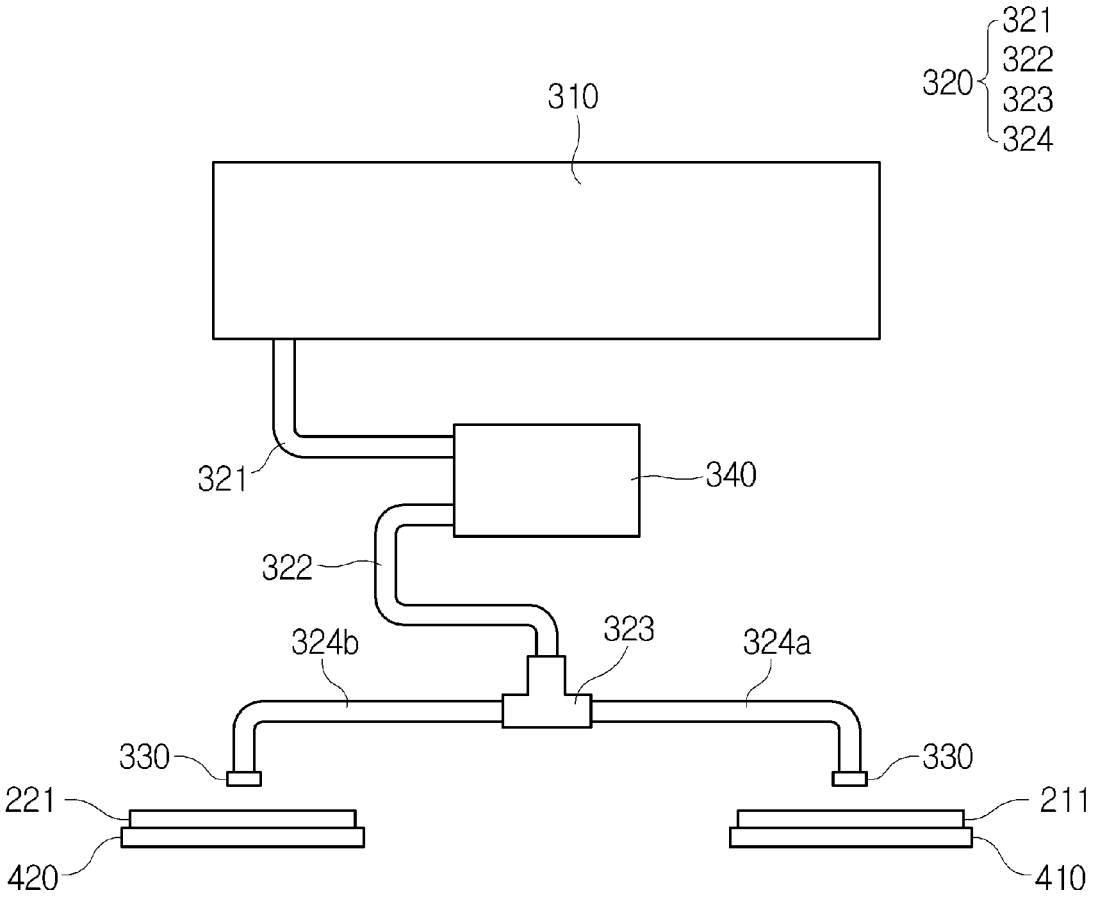
FIG. 9 is a conceptual view showing a process of supply water from a water tank to a rotation cleaning unit in the wet duster module of a cleaner according to the embodiment of the present disclosure viewed from another direction.

FIG. 8 is a view showing the arrangement of the rotating plate and the water supply nozzle in the wet duster module of a cleaner according to the embodiment of the present disclosure viewed from another direction. FIG. 9 is a conceptual view showing a process of supply water from the water tank to the rotation cleaning unit in the wet duster module of a cleaner according to the embodiment of the present disclosure viewed from another direction. FIG. 10 is a view showing the arrangement of the rotating plate and the water supply nozzle in the wet duster module of a cleaner according to the embodiment of the present disclosure viewed from another direction First, the water supply nozzle 330 will be described with reference to FIGS. 9 and 10.

The water supply nozzle 330 is configured to discharge the water of the water tank 310 to the dusters 410 and 420.

The water supply nozzle 330 may be mounted on the module cover 120 and may be received in an inner space formed by the module base 110 and the module cover 120.

As an example, the water supply nozzle 330 may be provided in the form of a pair in the inner space of the module housing 100, and may be arranged and mounted in the left and right direction. Also, the pair of water supply nozzles 330 arranged in the left and right direction may be formed in a symmetrical shape (mirror image). Therefore, in the embodiment, the description is made based on the water supply nozzle 330 mounted on the left side, but it is not limited thereto. Even if the water supply nozzle 330 is formed in a symmetrical shape, the water supply nozzle 330 is included in the embodiment of the present disclosure.

The water supply nozzle 330 may include a flowing part in which water introduced from the water tank 310 can flow and a water outlet. More specifically, the flowing part may be formed in a hollow shape so that water can flow in the flowing part. The water outlet for discharging the water to the dusters 410 and 420 may be formed at one side end of the flowing part in the axial direction.

The water outlet may extend downward through the nozzle hole 117. The water outlet may be disposed on the outside of the module housing 100.

As such, when the water outlet is disposed on the outside of the module housing 100, the water sprayed through the water outlet can be prevented from being introduced into the interior of the module housing 100.

Here, in order to prevent the water outlet exposed to the outside of the module housing 100 from being damaged, an upward recess may be formed in the bottom of the module base 110, and the water outlet passes through the nozzle hole 117 and then may be positioned within the recess. That is, the nozzle hole 117 may be formed in the recess.

Also, the water outlet may be arranged to face the rotating plates 211 and 221 in the recess. The bottom surface of the water outlet may be positioned at the same height as or positioned higher than the bottom surface of the module base 110.

Meanwhile, the water sprayed from the water outlet may pass through the water passage hole 211*d* of the rotating plates 211 and 221 (see FIG. 10).

A minimum radius of the water passage hole 211*d* at the center of the rotating plates 211 and 221 is R2, and a maximum radius of the water passage hole 211*d* at the center of the rotating plates 211 and 221 is R3.

A radius from the center of the rotating plates 211 and 221 to the center of the water outlet is R4. Here, R4 is larger than R2 and smaller than R3.

Also, D1 that is a difference between R3 and R2 is formed to be larger than the diameter of the water outlet.

Also, D1 that is a difference between R3 and R2 is formed to be smaller than a minimum width W1 of the water passage hole 211*d*.

Also, when an outer diameter (outer radius) of the rotating plates 211 and 221 is R1, R3 may be formed to be larger than a half of R1.

A line perpendicularly connecting the first rotation center C1 and a center line A1 of the first passage 130 is referred to as a first connection line A6, and a line perpendicularly connecting the second rotation center C2 and an axial line A1 of the first passage 130 is referred to as a second connection line A7.

Here, the first connection line A6 and the second connection line A7 are positioned in an area between a pair of the water outlets for supplying water to the rotation cleaning units 210 and 220.

That is, a horizontal distance D3 between the water outlet and the center line A2 of the second passage 140 is larger than a horizontal distance D2 between the rotation centers C1 and C2 of the rotating plates 211 and 221 and the center line A2 of the second passage 140.

This intends, because the second passage 140 extends from the center of the wet duster module 1 in the forward and backward direction, that water is prevented from being sucked into the wet duster module 1 through the second passage 140 during the rotation of the rotating plates 211 and 221.

A horizontal distance between the water outlet and the center line A1 of the first passage 130 is less than a horizontal distance between the rotation centers C1 and C2 and the center line A1 of the first passage 130.

The water outlet is located on the opposite side of the axial line of the driving units 250 and 270 with respect to the connection lines A6 and A7.

Hereinafter, a process of supplying water from the water tank 310 to the duster 400 will be described with reference to FIGS. 8 and 9.

Referring to FIGS. 8 and 9, the wet duster module 1 according to the embodiment of the present disclosure may further include a water supply pipe 320. The water supply pipe 320 connects the water tank 310 and the water supply nozzle 330 and has a passage that guides the water introduced from the water tank 310 to the water supply nozzle 330.

Specifically, the water supply pipe 320 includes a first water supply pipe 321, a second water supply pipe 322, and a third water supply pipe 324. The first water supply pipe 321 supplies water from the water tank 310 to the water pump 340. The second water supply pipe 322 supplies the water of the water pump 340 to a connector 323 to be described later. The third water supply pipe 324 supplies the water introduced into the connector 323 to the water supply nozzle 330.

The water pump 340 may include a first connection port 341 to which the first water supply pipe 321 is connected, and a second connection port 342 to which the second water supply pipe 322 is connected. With respect to the water pump 340, the first connection port 341 is an inlet, and the second connection port 342 is an outlet.

Also, the water supply pipe 320 according to the embodiment of the present disclosure may further include the connector 323 to which the second water supply pipe 322 is connected.

The connector 323 may be formed in such a way that a first connection portion 323*a*, a second connection portion 323*b*, and a third connection portion 323*c* are arranged in a T shape. The second water supply pipe 322 may be connected to the first connection portion 323*a*.

The third water supply pipe 324 may include a first branch pipe 324*a* connected to the second connection portion 323*b*, and a second branch pipe 324*b* connected to the third connection portion 323*c*.

Therefore, the water flowing through the first branch pipe 324*a* may be supplied to the first rotation cleaning unit 210, and the water flowing through the second branch pipe 324*b* may be supplied to the second rotation cleaning unit 220.

The first branch pipe 324*a* and the second secretion pipe 324*b* may be connected to the water supply nozzle 330. The water supply nozzle 330 also forms a passage for supplying water.

Accordingly, the water supplied to the first water supply pipe 321 is introduced into the water pump 340 and then flows to the second water supply pipe 322. The water flowing into the second water supply pipe 322 flows into the first branch pipe 324*a* and the second branch pipe 324*b* by the connector 323. Also, the water flowing into the first branch pipe 324*a* and the second branch pipe 324*b* is discharged from the water supply nozzle 330 toward the rotation cleaning units 210 and 220.

The water sprayed from the water supply nozzle 330 passes through the water passage hole 211*d* of the rotating plate 211 and 221 and then is supplied to the dusters 410 and 420. The dusters 410 and 420 absorb the supplied water and rotate to wipe the surface to be cleaned.

Hereinafter, the driving units 250 and 270 will be described with reference to FIGS. 11 and 12.

Figure 11:
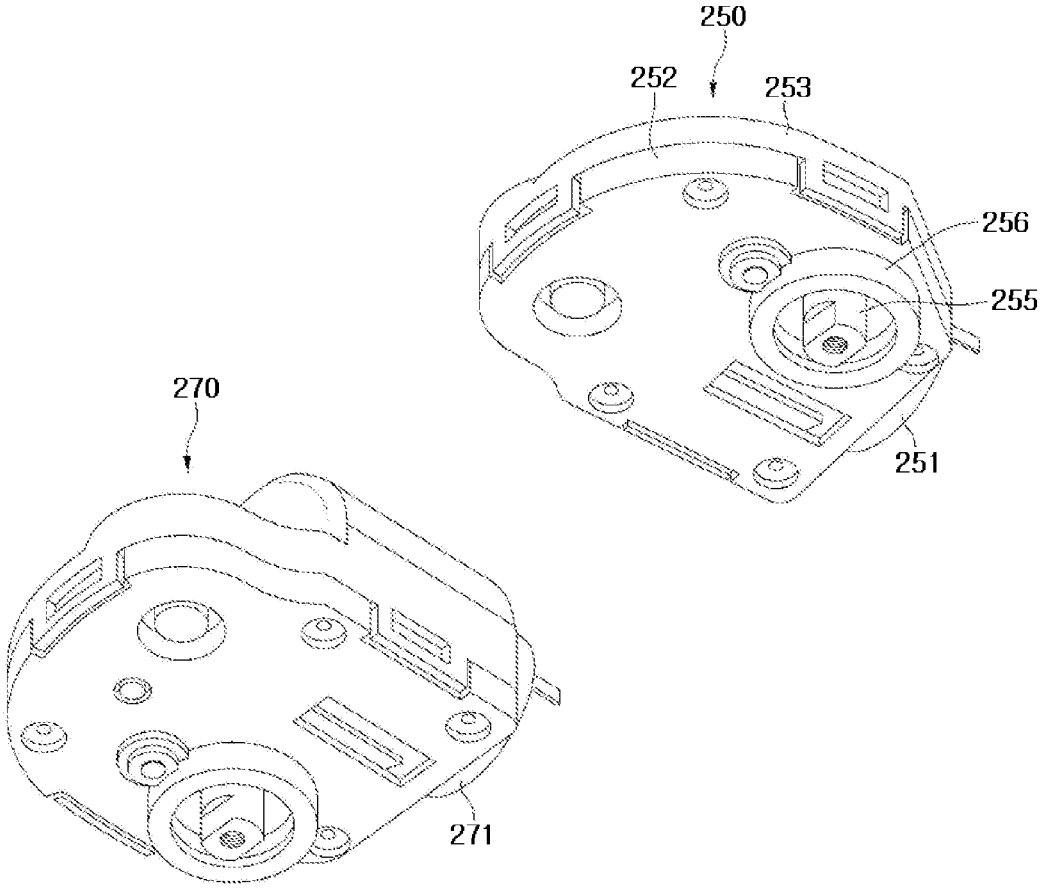
FIG. 11 is a perspective view of a driving unit in the wet duster module of a cleaner according to the embodiment of the present disclosure when viewed from the bottom.
Figure 12:
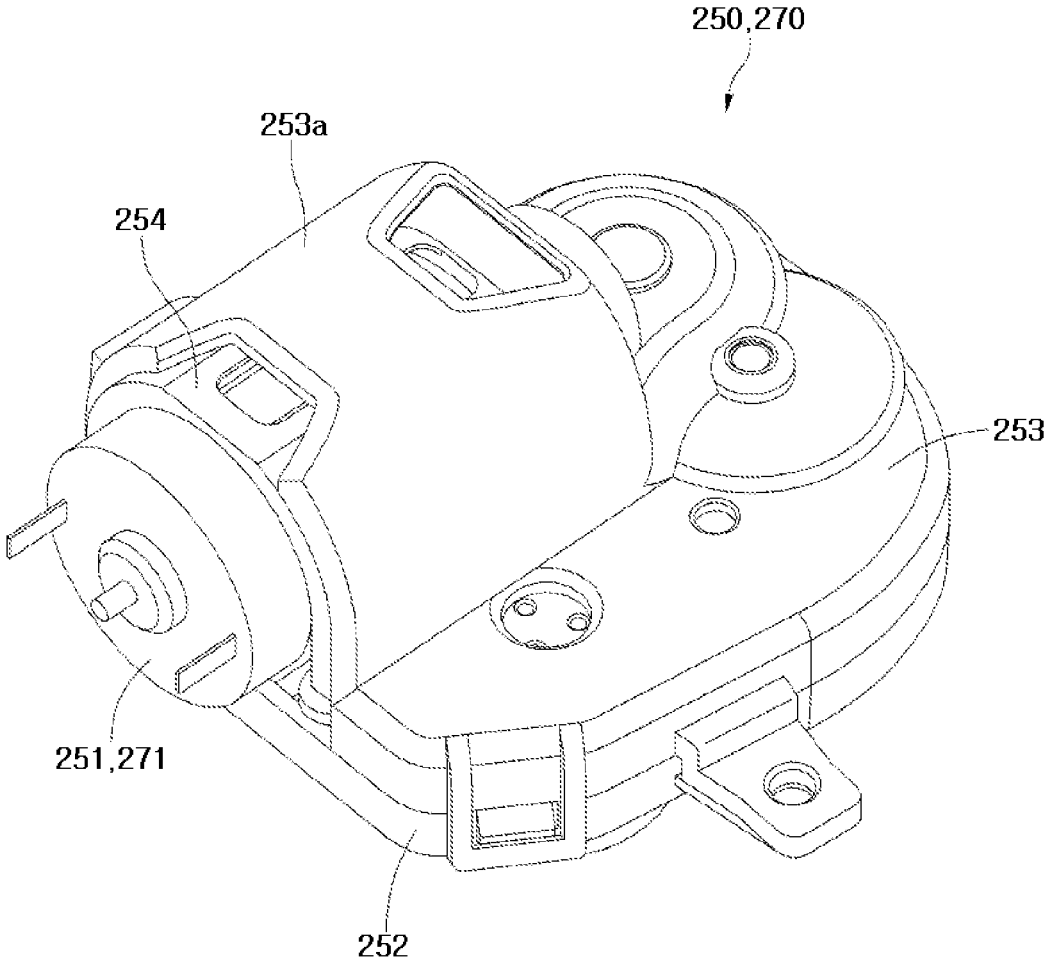
FIG. 12 is a perspective view for describing the driving unit in the wet duster module of a cleaner according to the embodiment of the present disclosure.

FIG. 11 is a perspective view of the driving unit in the wet duster module of a cleaner according to the embodiment of the present disclosure when viewed from the bottom. FIG. 12 is a perspective view for describing the driving unit in the wet duster module of a cleaner according to the embodiment of the present disclosure.

As described above, the driving units 250 and 270 may include the first driving unit 250 for driving the first rotation cleaning unit 210 and the second driving unit 270 for driving the second rotation cleaning unit 220.

The first driving unit 250 and the second driving unit 270 may be formed and arranged in the form of a left-right symmetrical shape within the module housing 100.

The driving units 250 and 270 includes drive motors 251 and 271, respectively. More specifically, the first driving unit 250 may include a first drive motor 251, and the second driving unit 270 may include a second drive motor 271.

The drive motors 251 and 271 may be connected to the rotating plates 211 and 221 included in the rotation cleaning units 210 and 220 and may transmit rotation power to the rotating plates 211 and 221. More specifically, the first drive motor 251 and the second drive motor 271 may be connected to the first rotating plate 211 and the second rotating plate 221, respectively, through the transmission shaft 255 passing through the shaft through holes 112 and 113. (see FIGS. 4, 6, and 7)

A motor PCB for driving the drive motors 251 and 271 may be connected to the drive motors 251 and 271, respectively. The motor PCB may be connected to the control board 800 and may receive a control signal. For example, the motor PCB may be connected to the drive motors 251 and 271 in an erect state and may be spaced apart from the module base 110.

Each of the driving units 250 and 270 may further include motor housings 252 and 253. The drive motors 251 and 271 and a power transmission unit for transmitting power may be received within the motor housings 252 and 253.

The motor housings 252 and 253 may include, for example, the first motor housing 252 and the second motor housing 253 coupled to the upper side of the first motor housing 252.

With the drive motors 251 and 271 installed in the motor housings 252 and 253, axial lines A3 and A4 of the drive motors 251 and 271 extend in the forward and backward direction of the module housing 100. (See FIG. 15) When the axial lines A3 and A4 of the drive motors 251 and 271 each are installed in the motor housings 252 and 253 such that the axial lines A3 and A4 extend in the forward and backward direction, the driving units 250 and 270 can be compacted. That is, the height of the driving units 250 and 270 can be reduced.

The first motor housing 252 may have a shaft hole formed therein through which the transmission shaft 255 which is fastened to each of the rotating plates 211 and 221 passes. For example, a portion of the transmission shaft 255 may pass through the lower sides of the motor housings 252 and 253 and protrude downward.

The sleeve 256 may be provided around the shaft hole in the first and second motor housings 253. The sleeve 256 may protrude from the bottom surfaces of the first and second motor housings 253.

The sleeve 256 may be, for example, formed in a ring shape. Accordingly, the sleeve 256 can be seated in the circular seating recesses 112*a* and 113*a*.

The drive motors 251 and 271 may be seated in the first motor housing 252. In this state, the drive motors 251 and 271 can be fixed to the first motor housing 252 by a motor fixing portion 254.

The drive motors 251 and 271 may be formed in a substantially cylindrical shape. With the axial lines A3 and A4 of the drive motors 251 and 271 disposed in the forward and backward direction of the module housing 100 (that is, with the drive motor laid), the drive motors 251 and 271 may be seated in the first motor housing 252.

The motor fixing portion 254 may surround the upper portion of the drive motors 251 and 271 seated in the first motor housing 252.

For example, the motor fixing portion 254 may be fixed to the first motor housing 252 by a fastening member such as a screw.

The second motor housing 253 may include a motor cover 253*a* that covers a portion of the drive motors 251 and 271.

For example, the motor cover 253*a* may be formed in a rounded shape to surround the motor fixing portion 254 on the outside of the motor fixing portion 254.

As an example, the motor cover 253*a* may be formed in a rounded shape such that a portion of the second motor housing 253 is upwardly convex, and may cover a portion of the upper side of the drive motors 251 and 271.

The power transmission unit may include a drive gear and a plurality of transmission gears. The drive gear is connected to the rotation shaft A3 of each of the drive motors 251 and 271. The plurality of transmission gears transmits a rotational force of the drive gear. Among the plurality of transmission gears, a transmission gear that is an output terminal of the power transmission unit may be coupled to the above-described transmission shaft 255.

Hereinafter, an air-cooled cooling mechanism provided to cool the driving units 250 and 270 in the wet duster module 1 according to the embodiment of the present disclosure will be described with reference to FIGS. 6, 7, and 13 to 16.

Figure 13:
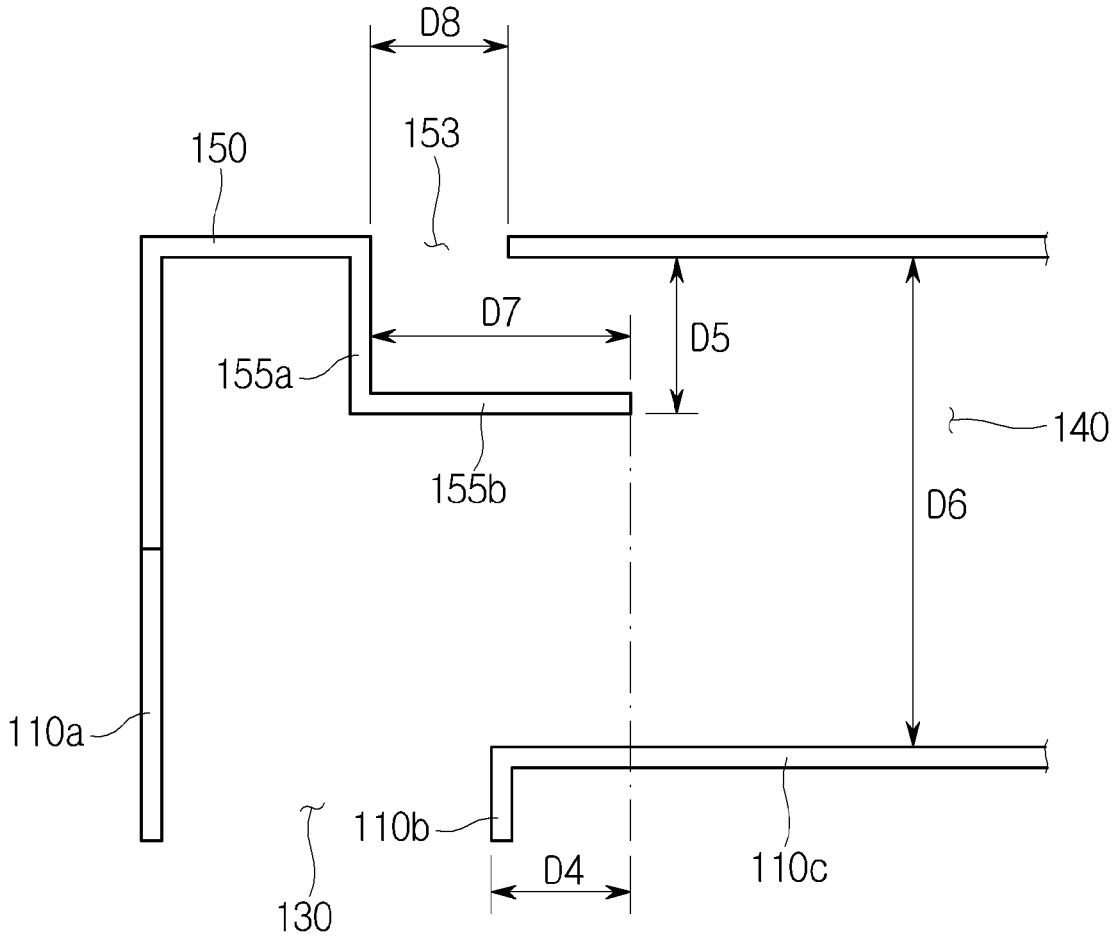
FIG. 13 is a view for describing a guide portion connected to a passage hole in the wet duster module of a cleaner according to the embodiment of the present disclosure.
Figure 14A:
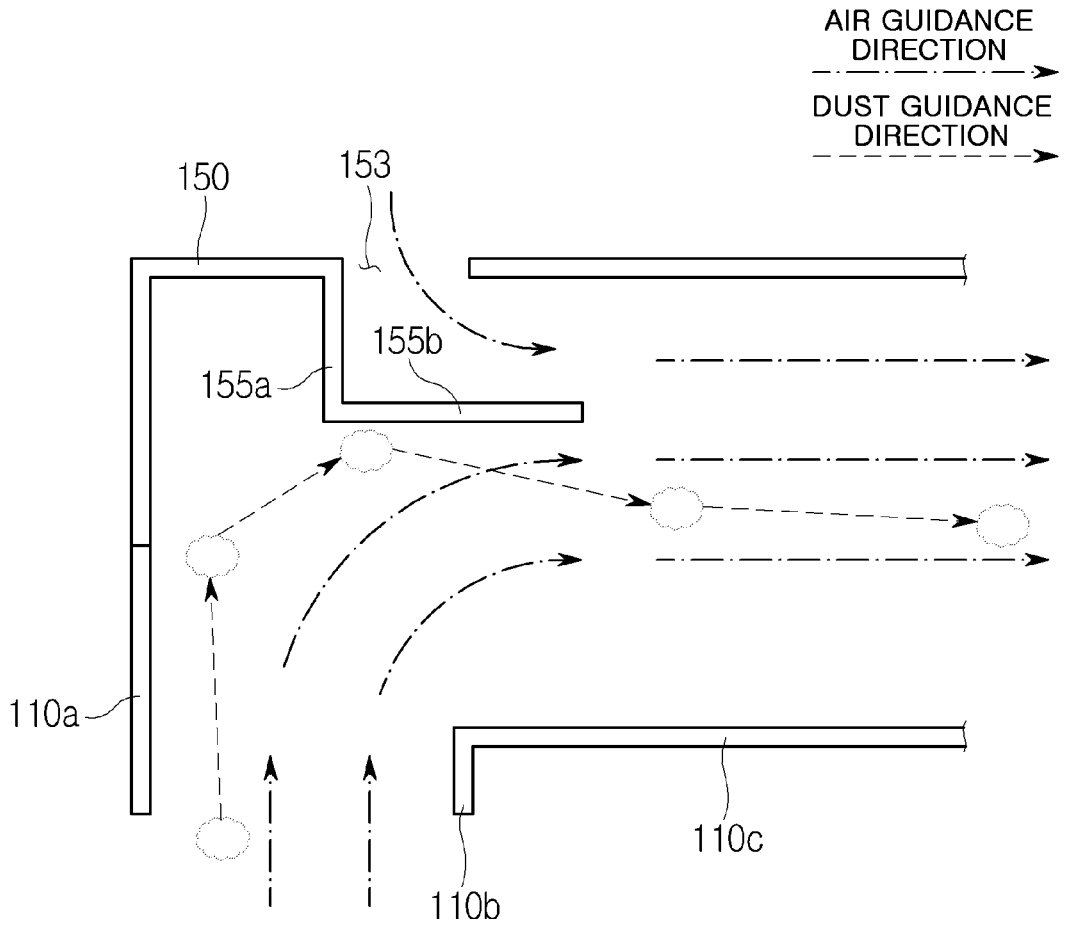
FIGS. 14A and 14B are views for describing a difference according to whether the guide portion is disposed or not in the wet duster module of a cleaner according to the embodiment of the present disclosure.
Figure 14B:
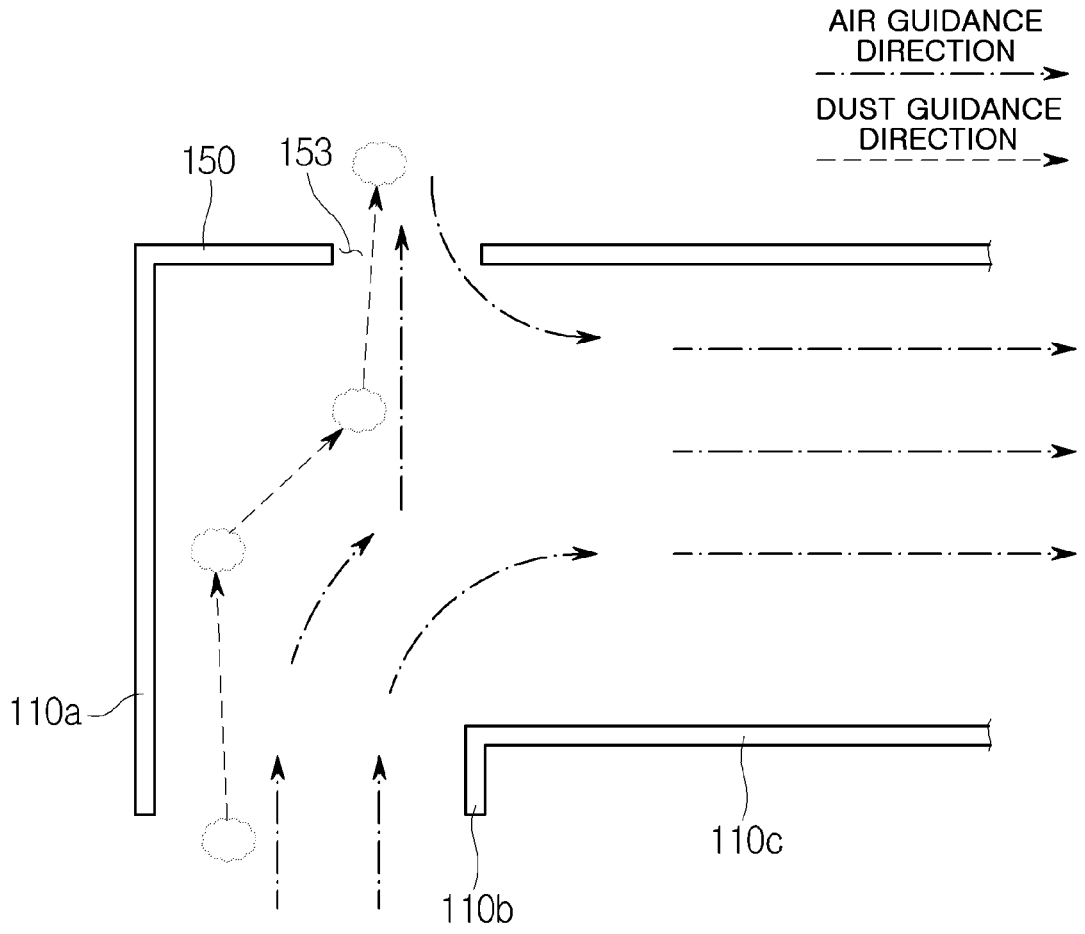
Figure 15:
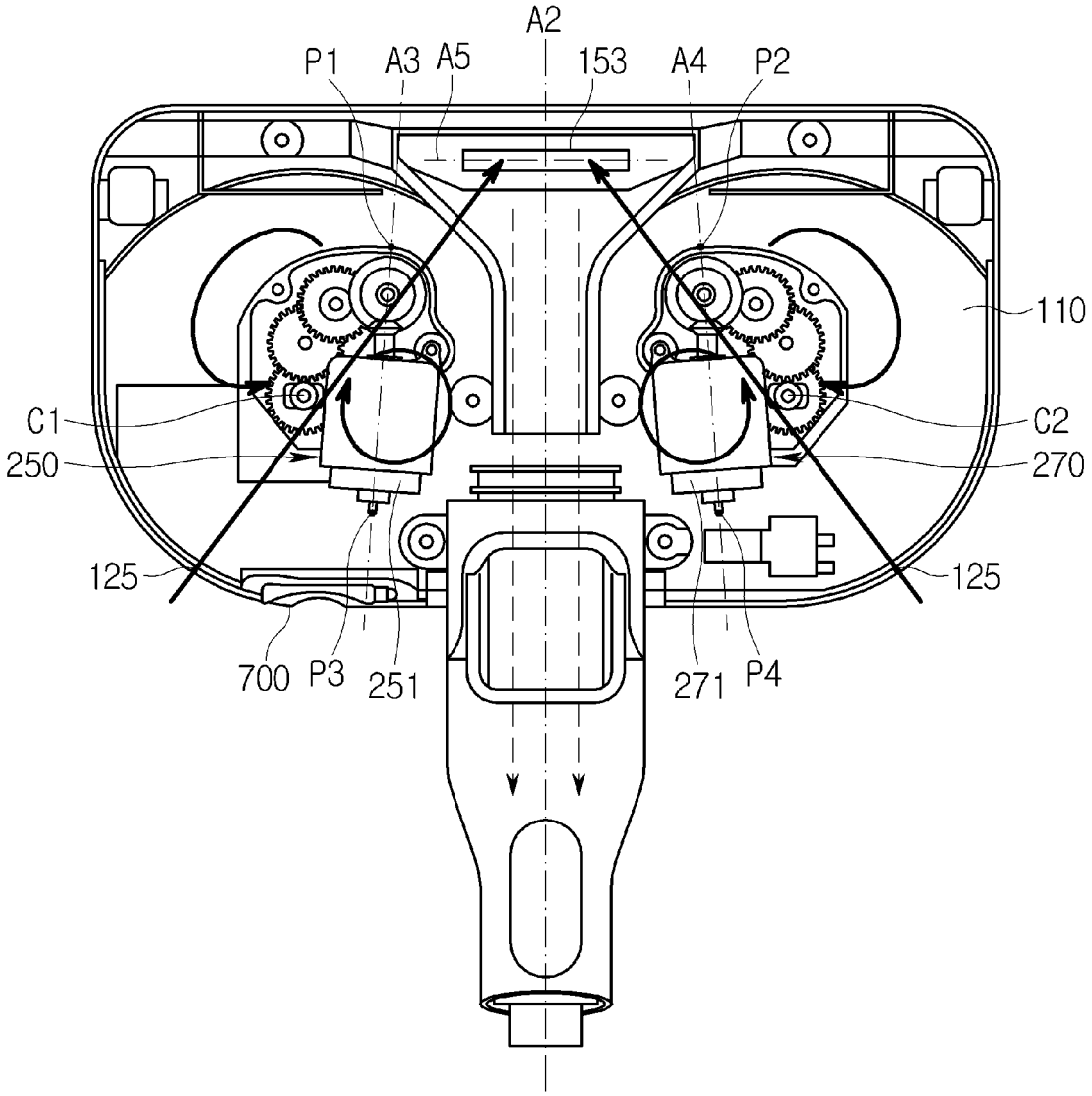
FIG. 15 is a view showing a flow direction of air in a cooling mechanism of the wet duster module of a cleaner according to the embodiment of the present disclosure.
Figure 16:
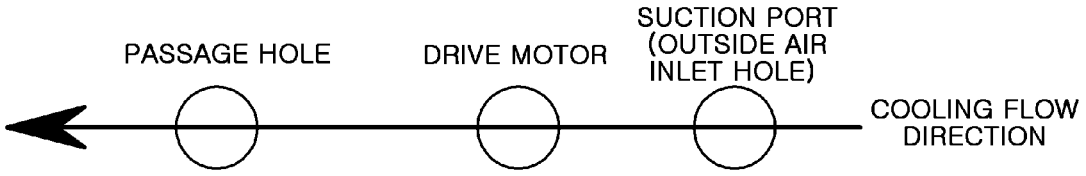
FIG. 16 is a conceptual view showing positional relationship between components in the cooling mechanism according to the embodiment of the present disclosure.

FIG. 13 is a view for describing a guide portion connected to a passage hole in the wet duster module of a cleaner according to the embodiment of the present disclosure. FIGS. 14A and 14B are views for describing a difference according to whether the guide portion is disposed or not in the wet duster module of a cleaner according to the embodiment of the present disclosure. FIG. 15 is a view showing a flow direction of air in a cooling mechanism according to the embodiment of the present disclosure. FIG. 16 is a conceptual view showing positional relationship between components in the cooling mechanism according to the embodiment of the present disclosure.

In the wet duster module 1 according to the embodiment of the present disclosure, the above-described driving units 250 and 270 can be cooled by forcibly convecting the air around the driving units 250 and 270 without depending on natural convection.

To this end, the wet duster module 1 according to the embodiment of the present disclosure may further include a passage hole 153 that communicates the second passage 140 with the inner space of the module housing 100.

Referring to FIG. 6 for a more detailed description, the passage hole 153 may be provided in the passage forming part 150. Here, the passage hole 153 may be provided in the top surface of the passage forming part 150. Specifically, the passage hole 153 may be formed to pass through the top surface of the passage forming part 150.

Since the passage forming part 150 is provided within the inner space of the module housing 100, the second passage 140 and the inner space of the module housing 100 can be in communication with each other by the passage hole 153 that passes through the top surface of the passage forming part 150.

The passage hole 153 may be provided in the form of a slot that is longer in the left and right direction than in the forward and backward direction. As an example, the passage hole 153 may be, as shown in FIG. 6, provided as a quadrangular hole. Alternatively, the passage hole 153 may be provided as an elliptical long hole extending left and right. The shape of the passage hole 153 is not limited to the above-described shapes as long as the passage hole 153 performs a function of communicating the second passage 140 and the inner space of the module housing 100.

Meanwhile, the inner space of the module housing 100, which is repeatedly described, may mean an inner space formed by combining the module base 110 and the module cover 120. The above-described driving units 250 and 270 can be received in the inner space.

As described above, the first passage 130 may be formed in the module base 110. More specifically, referring to FIG. 7, the module base 110 may include a passage front wall 110*a* disposed at the front end thereof. The passage front wall 110*a* may form a portion of the front lower external appearance of the wet duster module 1.

The module base 110 may further include a passage rear wall 110*b* which is connected to the passage front wall 110*a* and forms the first passage 130 between the passage front wall 110*a* and the passage rear wall 110*b*.

The passage rear wall 110*b* may form a portion of the lower external appearance of the module base 110. The left and right ends of the passage front wall 110*a* may be bent backward and then may extend by a predetermined length to be connected to the left and right ends of the passage rear wall 110*b*.

The passage rear wall 110*b* may be connected to the plate receiving portion 119 on the left and right sides of the module base 110. The passage rear wall 110*b* may be connected to a bottom protrusion 110*c* at the center of the module base 110.

Here, the bottom protrusion 110*c* may be formed to protrude downward between the plate receiving portions 119 provided on the left and right sides of the module base 110.

The left and right ends of the bottom protrusion 110*c* may be connected to the plate receiving portion 119, respectively.

Meanwhile, the passage rear wall 110*b* may be provided to be bent in a rounded shape along the appearance of the duster 400.

The first passage 130 may be formed by being surrounded by the passage front wall 110*a* and the passage rear wall 110*b*. Here, the first passage 130 may mean a space where a vertical suction force acts in the upward direction from the surface to be cleaned.

Through this, foreign substances present on the surface to be cleaned can be sucked, together with air, into the first passage 130.

Meanwhile, as described above, the second passage 140 may be formed by the module base 110 and the passage forming part 150. The passage forming part 150 may be connected to the first passage 130 and may cover the first passage 130 from the top. Here, the second passage 140 may mean a space where a horizontal suction force acts backward.

The passage forming part 150 is disposed between the module base 110 and the module cover 120, thereby spatially separating the inner space of the module housing 100 and the second passage 140.

Accordingly, if the above-described passage hole 153 is not provided in the passage forming part 150, air in the inner space of the module housing 100 cannot flow into the second passage 140, and only air sucked through the first passage 130 can flow into the second passage 140.

In contrast to this, when the passage hole 153 is provided on the top surface of the passage forming part 150 as in the embodiment of the present disclosure, the air in the inner space of the module housing 100 can flow into the second passage 140 through the passage hole 153.

Therefore, when the wet duster module 1 according to the embodiment of the present disclosure is connected to the body of the cleaner and a suction force is provided to the wet duster module 1 by the suction motor provided in the body of the cleaner, the air in the inner space of the module housing 100 may be continuously sucked into the second passage 140 through the passage hole 153. That is, forced convection of air may occur in the inner space of the module housing 100.

When the convection of forcibly flowing air occurs in the inner space, there is an effect of cooling the driving units 250 and 270 disposed in the inner space.

Also, when the air convection is forcibly generated by the suction force, the convection occurs faster than natural convection of air, so the driving units 250 and 270 are cooled rapidly.

Meanwhile, the wet duster module 1 according to the embodiment of the present disclosure may further include a guide portion 155 connected to the passage hole 153.

The guide portion 155 may be provided to guide air in the inner space of the module housing 100 to the second passage 140.

More specifically, the guide portion 155 may include a first guide wall 155*a* and a second guide wall 155*b*.

Referring to FIG. 13, the first guide wall 155*a* may be connected to the passage hole 153 and may protrude from the top surface of the passage forming part 150 toward a lower portion of the second passage 140 by a predetermined length. The first guide wall 155*a* may be connected to the front of the passage hole 153.

A protruding length of the first guide wall 155*a* may be appropriately set in advance so as not to obstruct a moving path of air introduced from the first passage 130. It is preferable that the protruding length D5 should be less than half an up and down length D6 of the second passage 140.

By the first guide wall 155*a*, the air which has passed through the passage hole 153 may be guided vertically downward and introduced into the second passage 140.

With continued reference to FIG. 13, the second guide wall 155*b* may be connected to the first guide wall 155*a* and may be extended by a predetermined length toward the rear of the second passage 140. The second guide wall 155*b* may be connected to a lower end of the first guide wall 155*a*.

The second guide wall 155*b* may extend side by side with the top surface of the passage forming part 150. Here, what the second guide wall 155*b* extends side by side means that the second guide wall 155*b* is actually parallel and may include that an angle formed between the top surface of the passage forming part 150 and the second guide wall 155*b* is within five degrees.

Meanwhile, FIG. 13 shows the there is no difference in height between the front and rear of the top surface of the passage forming part 150. However, as described above, the front of the top surface of the passage forming part 150 is less than the rear of the top surface of the passage forming part 150. That is, the passage forming part 150 may have an inclined shape in which the top surface becomes higher from the front to the rear thereof. Here, the second guide wall 155*b* may also be extended in a shape in which the rear thereof is higher than the front thereof in such a way as to be side by side with the top surface of the passage forming part 150.

By the second guide wall 155*b*, the air which is introduced into the second passage 140 may be guided to the horizontal rear and may be introduced into the body of the cleaner through the connection pipe 50.

In this way, the air which is guided by the first guide wall 155*a* and the second guide wall 155*a* and is introduced into the second passage 140 is mixed with the air introduced through the first passage 130, flows into the connection pipe 50, and then is discharged to the outside through the body of the cleaner coupled to the wet duster module 1.

Meanwhile, one side end of the second guide wall 155*b*, which extends toward the rear of the second passage 140, may be disposed further rearward than the first passage 130. More specifically, referring to FIG. 13, the rear side end of the second guide wall 155*b* may be disposed further rearward in such a manner as to be spaced apart from the passage rear wall 110*b* by a predetermined distance D4.

Also, an extended length D7 of the second guide wall 155*b* may be greater than a front-to-back length (or width) D8 of the passage hole 153. In other words, the rear side end of the second guide wall 155*b* may be disposed further rearward than the rear side end of the passage hole 153.

Through this, it is possible to prevent dust introduced through the first passage 130 from flowing out through the passage hole 153.

This will be described in more detail as follows with reference to FIGS. 14A and 14B.

It is assumed with initial reference to FIG. 14B that there exists only the passage hole 153 without the guide portion 155.

When a suction force acts in a direction of the body of the cleaner, air containing dust is sucked into the first passage 130. The dust which has been introduced into the first passage 130 and has flowed vertically upward enters the second passage 140, and then the movement direction of the dust changes from the vertical direction to the horizontal direction. Here, as shown in FIG. 14*b*, dust that cannot overcome an inertia force acting upward flows out through the passage hole 153.

Dust flowing out through the passage hole 153 may be introduced into the inner space of the module housing 100 and accumulate. The inner space receives a number of parts vulnerable to dust, such as the driving units 250 and 270, the control board 800, etc. When dust continues to be introduced into the inner space, the wet duster module 1 may malfunction.

In contrast to this, when the guide portion 155 is provided as in the embodiment of the present disclosure shown in FIG. 14A, the dust sucked into the first passage 130 is blocked by the guide portion 155 and cannot flow out through the passage hole 153 even when the dust receives the inertia force.

That is, the guide portion 155 has an effect of preventing the dust from entering the inner space of the module housing 100.

Meanwhile, the above-described forced convection of air may be generated when outside air flows into the inner space of the module housing 100 through a gap generated in an assembly portion between the module cover 120 and the module base 110.

That is, low-temperature air is introduced into the inner space from the outside through the assembly gap, and the introduced air carries out heat exchange with the driving units 250 and 270 while passing through the driving units 250 and 270, so that the driving units 250 and 270 can be cooled. Then, the heated air is sucked into the second passage 140 through the passage hole 153, moves to the body of the cleaner, and then is discharged to the outside.

As another example, the wet duster module 1 according to the embodiment of the present disclosure may further include an outside air inlet hole 125 provided to introduce outside air into the inner space formed by the module base 110 and the module cover 120.

Referring again to FIG. 5 for a more detailed description, the outside air inlet hole 125 may be disposed in the rear of the module cover 120.

The outside air inlet hole 125 is provided to passes through the rear of the module cover 120, thereby allowing outside air to flow into the inner space of the module housing 100. For example, the outside air inlet hole 125 may have a circular shape. Alternatively, as an example, the outside air inlet hole 125 may have a shape of an elliptical long hole having longer left and right sides.

For example, the outside air inlet hole 125 may be provided on the left and right sides with respect to the center line A2 of the second passage 140, respectively. (see FIG. 15) When the outside air inlet hole 125 is provided on the left and right sides, respectively, the outside air inlet hole 125 may be disposed symmetrically with respect to the center line A2 of the second passage 140, but is not limited to this. For example, the outside air inlet hole 125 may be appropriately provided at a position that does not disturb the arrangement of components (control board 800, etc.) provided in the inner space of the module housing 110.

As such, with the outside air inlet hole 125, the forced convection of the air in the inner space of the module housing 100 can occur faster and more strongly than the convection which is generated by outside air introduced through the assembly gap between the module base 110 and the module cover 120. That is, the cooling efficiency of the driving units 250 and 270 can be further increased.

Here, the outside air inlet hole 125 may be disposed further rearward than the rearmost end of the driving units 250 and 270.

Also, here, the passage hole 125 may be disposed further forward than the frontmost end of the driving units 250 and 270.

More specifically, referring to FIG. 15, a longitudinal central axis A5 of the passage hole 153 may be disposed further forward than P1 and P2 that are the frontmost ends of the driving units 250 and 270. The P1 and P2 may mean the frontmost ends of the motor housings 252 and 253.

Also, the outside air inlet hole 125 may be disposed further rearward than P3 and P4 that are the rearmost ends of the driving units 250 and 270. The P3 and P4 may mean the rearmost ends of the drive motors 251 and 271.

That is, the driving units 250 and 270 may be disposed between the outside air inlet hole 125 and the passage hole 153. Referring to FIG. 16, such a positional relationship between the outside air inlet hole 125, the drive motors 251 and 271, and the passage hole 153 is shown. With this configuration, the air introduced into the outside air inlet hole 125 must pass through the driving units 250 and 270 necessarily while flowing, so that the cooling efficiency can be further increased.

Figure 17:
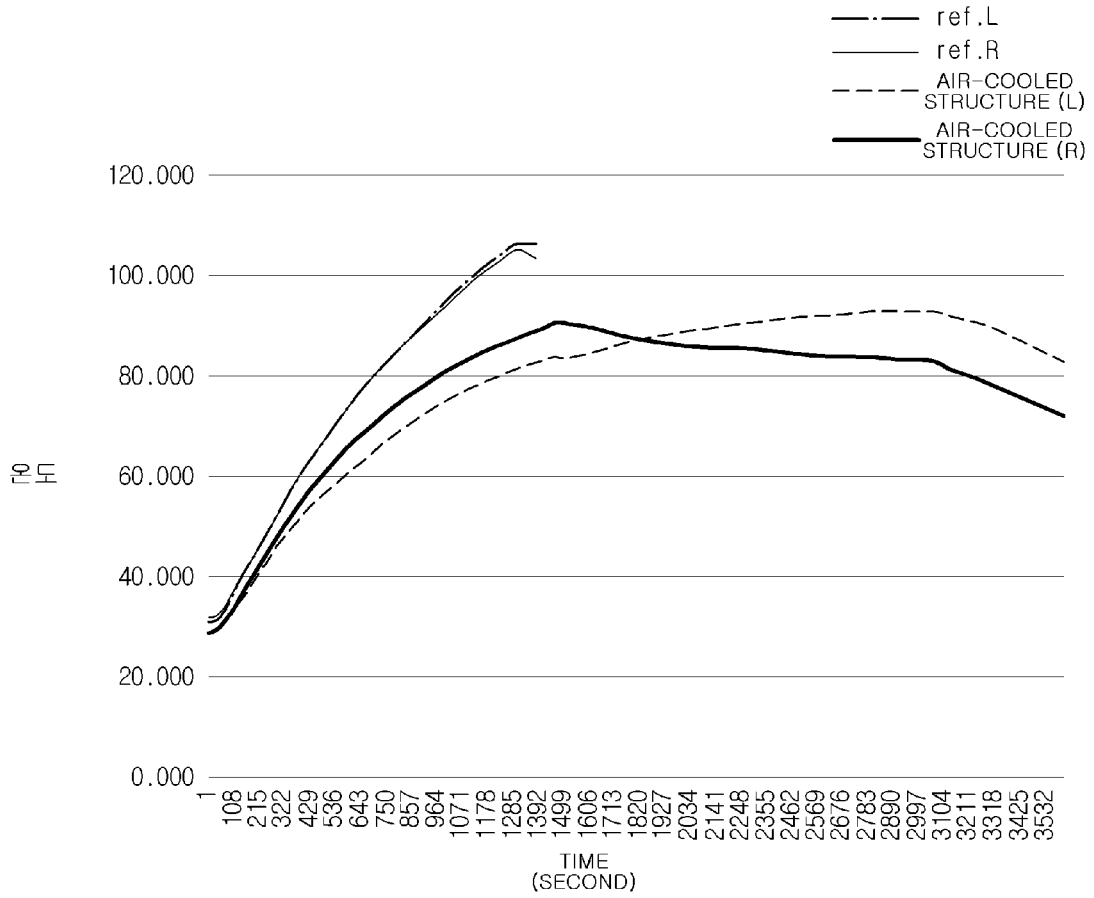
FIG. 17 is a graph showing experimental results obtained by comparing a cooling efficiency of a conventional wet duster module and a cooling efficiency of the wet duster module according to the embodiment of the present disclosure.

FIG. 17 is a graph showing experimental results obtained by comparing the cooling efficiency of a conventional wet duster module and the cooling efficiency of the wet duster module according to the embodiment of the present disclosure.

In FIG. 17, "ref.L" and "ref.R" represent temperature changes over time of the driving units arranged on the left and right sides, respectively, in a conventional wet duster module. An air-cooled structure L and an air-cooled structure R represent temperature changes over time of the driving units 250 and 270 included in the wet duster module 1 provided with the passage hole 153 according to the embodiment of the present disclosure.

Referring to FIG. 17, it can be seen that the driving units 250 and 270 included in the wet duster module 1 according to the embodiment of the present disclosure have a lower temperature than that of a driving unit included in the conventional wet duster module when they are operated for the same period of time. That is, it can be understood from the graph of FIG. 17 that the wet duster module 1 according to the embodiment of the present disclosure has higher cooling efficiency.

As described above, the wet duster module of the cleaner according to the embodiment of the present disclosure can cause forced convection of the air in the inner space through the passage hole that communicates the suction passage and the inner space of the module housing without having a separate cooling module. Therefore, the cooling efficiency of the driving unit disposed in the inner space can be increased. Accordingly, this can not only contribute to the miniaturization of the wet duster module but also adopt the drive motor with higher output, thereby enabling high performance of the wet duster module.

Although the present invention has been described above by way of the specific embodiments, this is for describing the present invention in detail. The present invention is not limited thereto and it is clear that the present invention can be modified or improved within the spirit of the present invention by those of ordinary skill in the art.

All simple modifications or changes of the present invention fall within the scope of the present invention. The specific scope of protection of the present invention will be apparent by the appended claims.

The invention claimed is:

1. A wet duster configured to be connected to a cleaner, the wet duster comprising:

a housing that defines an inner space therein;

a first passage that is configured to guide air and extends in a first direction along a bottom surface of the housing;

a second passage connected to the first passage and configured to guide the air from the first passage, the second passage extending in a second direction intersecting the first direction;

a plurality of rotation cleaners that are disposed at the bottom surface of the housing and positioned rearward relative to the first passage in the second direction, the plurality of rotation cleaners being spaced apart from one another in the first direction, wherein the second passage is disposed between the plurality of rotation cleaners; and a plurality of drivers that are disposed in the inner space of the housing and spaced apart from one another in the first direction, the plurality of drivers being configured to rotate the plurality of rotation cleaners, respectively, wherein the second passage and the inner space of the housing are fluidly connected to each other via a passage hole, and wherein the wet duster further comprises a guide configured to guide the air in the inner space of the housing to the second passage via the passage hole.

2. The wet duster of claim 1, wherein the housing comprises:

a base that defines the first passage and supports the plurality of drivers;

a cover coupled to an upper side of the base; and a passage forming wall that is coupled to the base and defines the second passage, the passage forming wall being disposed between the base and the cover.

3. The wet duster of claim 2, wherein the passage forming wall defines the passage hole that passes through a top surface of the passage forming wall.

4. The wet duster of claim 3, further comprising a connection pipe connected to a rear side of the housing and configured to guide the air from the second passage to the cleaner, wherein the passage forming wall has (i) a front end connected to the first passage and (ii) a rear end connected to the connection pipe.

5. The wet duster of claim 3, wherein the guide is disposed in the second passage and connected to the passage forming wall.

6. The wet duster of claim 5, wherein the guide comprises:

a first guide wall that is connected to the passage hole and protrudes from the top surface of the passage forming wall toward a lower portion of the second passage, the first guide wall having a first predetermined length; and a second guide wall that is connected to the first guide wall and extends toward a rear side of the second passage, the second guide wall having a second predetermined length.

7. The wet duster of claim 6, wherein the second guide wall is spaced apart from and extends along the top surface of the passage forming wall toward the rear side of the second passage.

8. The wet duster of claim 6, wherein an end of the second guide wall extends toward the rear side of the second passage and is disposed further rearward relative to the first passage.

9. The wet duster of claim 6, wherein the second predetermined length is greater than the first predetermined length.

10. The wet duster of claim 1, wherein the housing comprises:

a base that defines the first passage and supports the plurality of drivers; and a cover coupled to an upper side of the base, the cover defining an outside air inlet hole configured to introduce outside air into a space defined by the base and the cover.

11. The wet duster of claim 10, wherein the outside air inlet hole is disposed further rearward relative to a rearmost end of the plurality of drivers.

12. The wet duster of claim 1, wherein each of the plurality of drivers comprises a motor.

13. The wet duster of claim 1, wherein each of the plurality of rotation cleaners comprises a rotating plate configured to rotate about an axis perpendicular to the bottom surface of the housing.

14. The wet duster of claim 1, wherein a width of the second passage in the first direction is greater than a width of the first passage in the second direction.

15. The wet duster of claim 1, wherein the passage hole is defined above the second passage.

16. A wet duster for a cleaner, the wet duster comprising:

a housing that defines an inner space therein, the housing defines a first passage that is configured to guide air and extends in a first direction along a bottom surface of the housing;

a passage forming wall that is disposed in the housing and defines a second passage, the second passage being connected to the first passage and extending in a second direction intersecting the first direction;

a rotation cleaner disposed at the bottom surface of the housing and positioned rearward relative to the first passage in the second direction; and a drive motor disposed in the inner space of the housing and configured to rotate the rotation cleaner, wherein the passage forming wall further defines a passage hole that fluidly connects the second passage and the inner space of the housing to each other, wherein the second passage and the passage hole are disposed rearward relative to the first passage in the second direction, and wherein the wet duster further comprises a guide configured to guide the air in the inner space of the housing to the second passage via the passage hole.

17. The wet duster of claim 16, wherein the passage hole is defined at a top surface of the passage forming wall above the second passage.

18. The wet duster of claim 16, wherein the rotation cleaner is one of a pair of rotation cleaners that are disposed at the bottom surface of the housing and spaced apart from each other in the first direction, and wherein the second passage is disposed between the pair of rotation cleaners.

19. The wet duster of claim 18, wherein the drive motor is one of a pair of drive motors that are disposed in the inner space of the housing and spaced apart from each other in the first direction, the pair of drive motors being configured to rotate the pair of rotation cleaners, respectively.

20. The wet duster of claim 16, wherein the rotation cleaner comprises a rotating plate configured to rotate about an axis perpendicular to the bottom surface of the housing.

* * * * *